US008058961B2

(12) United States Patent
Hébert et al.

(10) Patent No.: US 8,058,961 B2
(45) Date of Patent: Nov. 15, 2011

(54) LEAD FRAME-BASED DISCRETE POWER INDUCTOR

(75) Inventors: François Hébert, San Mateo, CA (US); Tao Feng, Santa Clara, CA (US); Xiaotian Zhang, San Jose, CA (US); Jun Lu, San Jose, CA (US)

(73) Assignee: Alpha and Omega Semiconductor Incorporated, Sunnyvale, CA (US)

( * ) Notice: Subject to any disclaimer, the term of this patent is extended or adjusted under 35 U.S.C. 154(b) by 0 days.

(21) Appl. No.: 13/021,347

(22) Filed: Feb. 4, 2011

(65) Prior Publication Data

US 2011/0121934 A1 May 26, 2011

Related U.S. Application Data

(63) Continuation of application No. 12/011,489, filed on Jan. 25, 2008, now Pat. No. 7,884,696.

(51) Int. Cl.
*H01F 5/00* (2006.01)

(52) U.S. Cl. ..... 336/200

(58) Field of Classification Search ..... 336/65, 336/83, 200, 232; 257/531
See application file for complete search history.

(56) References Cited

U.S. PATENT DOCUMENTS

| | | | | |
|---|---|---|---|---|
| 3,614,554 | A | 10/1971 | Shield et al. | |
| 3,858,138 | A | 12/1974 | Gittleman et al. | |
| 4,103,267 | A | 7/1978 | Olschewski | |
| 4,543,553 | A | 9/1985 | Mandai et al. | |
| 5,032,815 | A | 7/1991 | Kobayashi et al. | |
| 5,041,903 | A | 8/1991 | Millerick et al. | |
| 5,070,317 | A | 12/1991 | Bhagat | |
| 5,336,921 | A * | 8/1994 | Sundaram et al. | 257/531 |
| 5,425,166 | A | 6/1995 | Hastings et al. | |
| 5,428,245 | A | 6/1995 | Lin et al. | |
| 5,469,334 | A | 11/1995 | Balakrishnan et al. | |
| 5,886,393 | A | 3/1999 | Merrill et al. | |
| 5,959,846 | A | 9/1999 | Noguchi et al. | |
| 6,236,538 | B1 | 5/2001 | Yamada et al. | |
| 6,281,778 | B1 * | 8/2001 | El-Sharawy et al. | 336/200 |
| 6,429,764 | B1 | 8/2002 | Karam et al. | |
| 6,608,367 | B1 | 8/2003 | Gibson et al. | |

(Continued)

FOREIGN PATENT DOCUMENTS

JP 05198440 A 8/1993

OTHER PUBLICATIONS

USPTO Office Action for U.S. Appl. No. 12/397,473, mailing date Sep. 15, 2010.

(Continued)

*Primary Examiner* — Tuyen Nguyen
(74) *Attorney, Agent, or Firm* — JingMing Cai; Schein & Cai LLP

(57) ABSTRACT

A lead frame-based discrete power inductor is disclosed. The power inductor includes top and bottom lead frames, the leads of which form a coil around a single closed-loop magnetic core. The coil includes interconnections between inner and outer contact sections of the top and bottom lead frames, the magnetic core being sandwiched between the top and bottom lead frames. Ones of the leads of the top and bottom lead frames have a generally non-linear, stepped configuration such that the leads of the top lead frame couple adjacent leads of the bottom lead frame about the magnetic core to form the coil.

5 Claims, 21 Drawing Sheets

U.S. PATENT DOCUMENTS

| | | | | |
|---|---|---|---|---|
| 6,621,140 | B1 | 9/2003 | Gibson et al. | |
| 6,630,881 | B1 | 10/2003 | Takeuchi et al. | |
| 6,765,284 | B2 | 7/2004 | Gibson et al. | |
| 6,803,848 | B2 * | 10/2004 | Yeo et al. | 336/200 |
| 6,847,104 | B2 | 1/2005 | Huang et al. | |
| 6,927,481 | B2 | 8/2005 | Gibson et al. | |
| 6,930,584 | B2 | 8/2005 | Edo et al. | |
| 6,998,952 | B2 | 2/2006 | Zhou et al. | |
| 7,046,114 | B2 | 5/2006 | Sakata | |
| 7,091,576 | B2 | 8/2006 | Yamamoto et al. | |
| 7,158,004 | B2 * | 1/2007 | Ahn et al. | 336/200 |
| 7,167,073 | B2 | 1/2007 | Hatano | |
| 7,196,514 | B2 | 3/2007 | Li | |
| 7,229,908 | B1 | 6/2007 | Drizlikh et al. | |
| 7,268,659 | B2 | 9/2007 | Nishio et al. | |
| 7,368,908 | B2 | 5/2008 | Yamada | |
| 7,524,731 | B2 * | 4/2009 | Wang | 438/381 |
| 7,622,796 | B2 | 11/2009 | Shi et al. | |
| 7,786,837 | B2 | 8/2010 | Hebert | |
| 7,948,346 | B2 * | 5/2011 | Hebert et al. | 336/200 |
| 2002/0097128 | A1 | 7/2002 | Imam | |
| 2003/0070282 | A1 | 4/2003 | Hiatt et al. | |
| 2004/0169266 | A1 | 9/2004 | Maxwell | |
| 2004/0212475 | A1 | 10/2004 | Schumacher | |
| 2006/0227518 | A1 | 10/2006 | Nishio et al. | |
| 2007/0026676 | A1 | 2/2007 | Li et al. | |
| 2008/0061918 | A1 | 3/2008 | Greiff | |
| 2008/0094165 | A1 | 4/2008 | Orlando et al. | |
| 2008/0238599 | A1 | 10/2008 | Hebert et al. | |
| 2009/0057822 | A1 | 3/2009 | Wen et al. | |
| 2010/0007456 | A1 | 1/2010 | Joehren et al. | |

OTHER PUBLICATIONS

International Preliminary Report on Patentability for International Patent Application No. PCT/US08/013043, mailing date Nov. 23, 2007.

International Search Report for International Patent Application No. PCT/US08/013043, mailed Jan. 26, 2009.

Written Opinion for International Patent Application No. PCT/US08/013043, mailing date Jan. 26, 2009.

* cited by examiner

LEAD FRAME-BASED DISCRETE POWER INDUCTOR

CROSS-REFERENCE TO RELATED APPLICATION

The instant patent application is a continuation patent application of and claims priority to U.S. patent application Ser. No. 12/011,489 filed on Jan. 25, 2008 now U.S. Pat. No. 7,884,696 which is herein incorporated by reference in its entirety.

BACKGROUND OF THE INVENTION

1. Field of the Invention

The present invention generally relates to discrete inductors and more particularly to a discrete inductor comprising top and bottom lead frames, the interconnected leads of which form a coil about a closed-loop magnetic core.

2. Description of the Related Art

A review of known discrete inductors reveals a variety of structures including encapsulated wire-wound inductors having either round or flat wire wound around a magnetic core. Exemplary magnetic cores include toriodal cores, "I" style drum cores, "T" style drum cores, and "E" style drum cores. Other known structures include wire wound devices having iron powder cores and metal alloy powder cores. It is also known to form a surface mount discrete inductor employing a wire wound around a magnetic core. The fabrication of wire wound inductors is an inefficient and complex process. Open spools are typically used to facilitate the winding of the wire around the drum core. In the case of toroidal cores, the wire must be repeatedly fed through the center hole.

Non-wire wound discrete inductors include solenoid coil conductors such as disclosed in U.S. Pat. No. 6,930,584 entitled "Microminiature Power Converter" and multi-layer inductors. Exemplary multi-layer inductors are disclosed in U.S. Pat. No. 4,543,553 entitled "Chip-type Inductor", U.S. Pat. No. 5,032,815 entitled "Lamination Type Inductor", U.S. Pat. No. 6,630,881 entitled "Method for Producing Multi-layered Chip Inductor", and U.S. Pat. No. 7,046,114 entitled "Laminated Inductor". These non-wire wound discrete inductors require multiple layers and are of complex structure and not easily manufacturable.

In view of the limitations of the prior art, there remains a need in the art for a discrete power inductor that is easily manufacturable in high volume using existing techniques. There is also a need in the art for a discrete power inductor that provides a low cost discrete power inductor. There is a further need in the art for discrete power inductor that maximizes the inductance per unit area and that minimizes resistance. There is also a need in the art for a compact discrete power inductor that combines a small physical size with a minimum number of turns to provide a small footprint and thin profile.

SUMMARY OF THE INVENTION

The discrete power inductor of the invention overcomes the disadvantages of the prior art and achieves the objectives of the invention by providing a power inductor comprising top and bottom lead frames, the interconnected leads of which form a coil about a single closed-loop magnetic core. The single magnetic core layer maximizes the inductance per unit area of the power inductor.

In one aspect of the invention, the bottom lead frame includes a plurality of bottom leads each having first and second contact sections disposed at respective ends thereof.

The bottom lead frame further includes a first terminal lead having a first contact section and a second terminal lead having a second contact section. The top lead frame includes a plurality of top leads each having first and second contact sections disposed at respective ends thereof.

In another aspect of the invention, the bottom lead frame includes a first side and a second side, the first and second sides being disposed opposite one another. A first set of leads comprises the first side and a second set of leads comprises the second side. The first set of leads includes a terminal lead having an inner contact section. The remaining leads of the first set of leads include inner and outer contact sections.

The bottom lead frame second set of leads includes a terminal lead having an outer contact section. The remaining leads of the second set of leads have inner and outer contact sections.

The bottom lead frame further includes a routing lead that extends between the first side and the second side. The routing lead has inner and outer contact sections.

The top lead frame includes a first side and a second side, the first and second sides being disposed opposite one another. A first set of leads comprises the first side and a second set of leads comprises the second side. Each of the top leads comprises an inner contact section and an outer contact section.

The coil about the single closed-loop magnetic core comprises interconnections between inner and outer contact sections of the top and bottom lead frames, the magnetic core being sandwiched between the top and bottom lead frames. Ones of the leads of the top and bottom lead frames have a generally non-linear, stepped configuration such that the leads of the top lead frame couple adjacent leads of the bottom lead frame about the magnetic core to form the coil.

In another aspect of the invention, the magnetic core is patterned with a window or hole in the center thereof to allow for connection between the inner contact sections of the top and bottom lead frame leads.

In another aspect of the invention, an interconnection structure or chip is disposed in the window of the magnetic core to facilitate connection between the inner contact sections of the top and bottom lead frame leads. The interconnection chip comprises conductive vias for coupling the inner contact sections.

In yet another aspect of the invention, a peripheral interconnection structure or chip is disposed in surrounding relationship to the magnetic core to facilitate connection between outer contact sections of the top and bottom lead frame leads. The peripheral interconnection chip comprises conductive vias for coupling the outer lead sections.

In still another aspect of the invention, the magnetic core is solid and conductive vias provide for connection between the inner contact sections of the top and bottom lead frame leads.

In yet another aspect of the invention, the magnetic core is solid and conductive vias provide for connection between the inner and outer contact sections of the top and bottom lead frame leads.

In still another aspect of the invention, leads of the top and bottom lead frames are bent such that the inner and outer contact sections thereof are disposed in a plane parallel to a plane of the lead frame.

In yet another aspect of the invention, the top leads are bent such that the inner and outer contact sections thereof are disposed in a plane parallel to the plane of the lead frame and the bottom leads are planar.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of functional components and to the arrangements of these components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

These and other aspects and features of the present invention will become apparent to those ordinarily skilled in the art upon review of the following description of specific embodiments of the invention in conjunction with the accompanying figures, wherein.

DETAILED DESCRIPTION OF A PREFERRED EMBODIMENT OF THE INVENTION

The present invention will now be described in detail with reference to the drawings, which are provided as illustrative examples of the invention so as to enable those skilled in the art to practice the invention. Notably, the figures and examples below are not meant to limit the scope of the present invention. Where certain elements of the present invention can be partially or fully implemented using known components, only those portions of such known components that are necessary for an understanding of the present invention will be described, and detailed descriptions of other portions of such known components will be omitted so as not to obscure the invention. Further, the present invention encompasses present and future known equivalents to the components referred to herein by way of illustration.

The present invention provides a lead frame-based discrete power inductor. Embodiments of the invention include a magnetic core having a window or hole formed in a center thereof to allow for connection between inner contact sections of top and bottom lead frame leads to thereby form a coil of the power inductor as further described herein. The magnetic core is preferably of toroidal configuration and as thin as 100 microns in thickness, for applications requiring thin inductors. The magnetic core may be formed of ferrite or nanocrystalline NiFe for high frequency applications and of NiFe, NiZn or other suitable magnetic materials for low frequency applications. One of the primary applications considered for the discrete power inductors described herein, is for use in DC-DC power converters which operate in the 1 MHz to 5 MHz range, with output currents of 1 A or below, with inductance values in the 0.4 to 2.0 uH range, and DC series resistance of less than 0.15 ohms. The coil of the power inductor in accordance with the invention is comprised of interconnected contact sections of the leads of the top and bottom lead frames about the magnetic core. The interconnection may be accomplished using standard semiconductor packaging material techniques including soldering and the use of conductive epoxies. The top and bottom lead frames are preferably between 100 and 200 microns thick and formed from a low resistance material including copper and other conventional alloys used in the fabrication of lead frames. Combined with the magnetic core, the total thickness of the power inductor in accordance with the invention can be much less than 1 mm if necessary, which is desirable for many applications such as hand-held devices and portable electronic products.

Figure 1A:
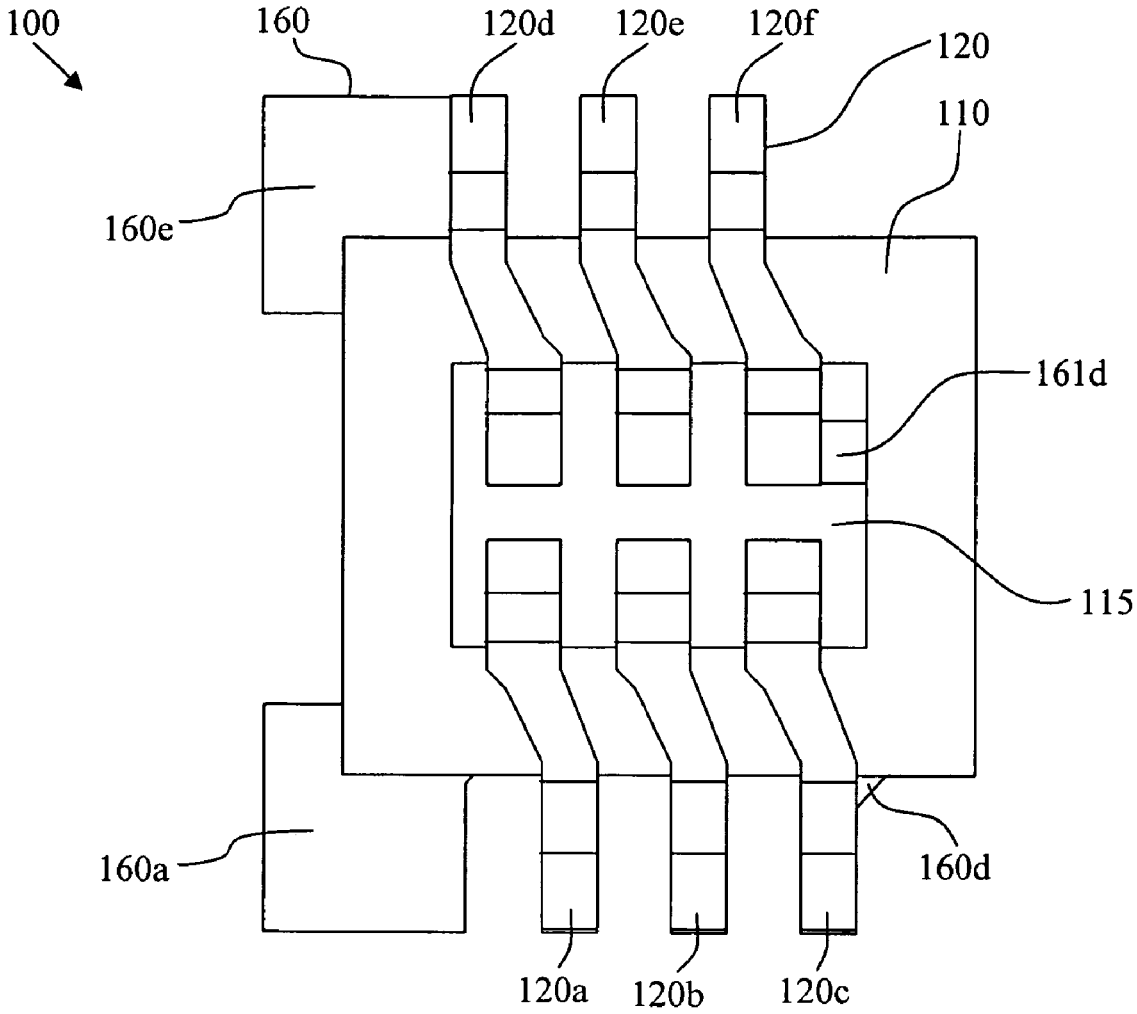
FIG. 1A is a top plan view of a first embodiment of a lead frame-based discrete power inductor in accordance with the invention.

A first embodiment of a lead frame-based discrete power inductor generally designated 100 is shown in FIG. 1A. The inductor 100 comprises a magnetic core 110, a top lead frame 120 and a bottom lead frame 160, the leads of which are interconnected about the magnetic core 110. The lead frame 160 is made of a conductive material, preferably metallic, including copper, Alloy 42, and plated copper. The magnetic core 110 includes a window or hole 115 formed in a center thereof (FIG. 1C).

Figure 1B:
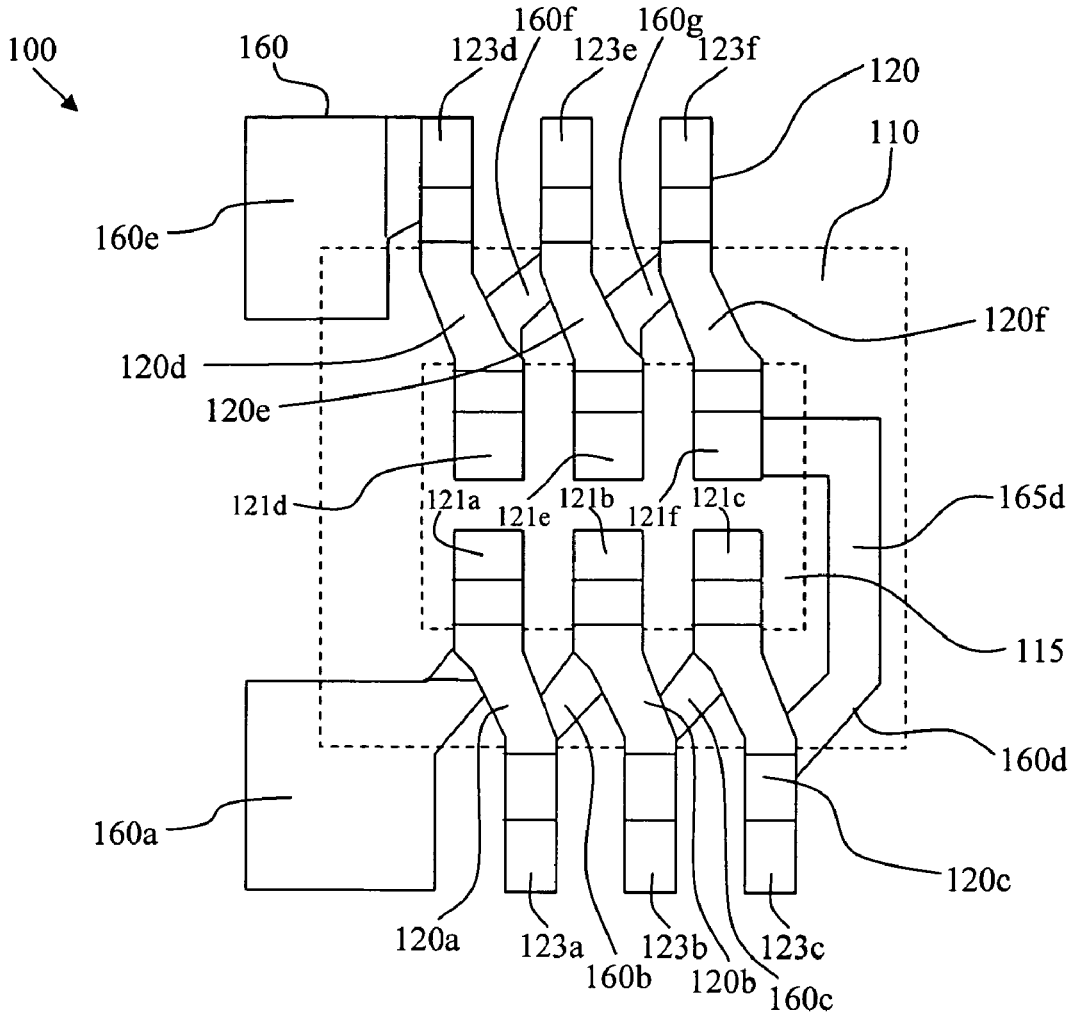
FIG. 1B is a top plan view of the lead frame-based discrete power inductor of FIG. 1A showing a magnetic core in phantom.
Figure 1C:
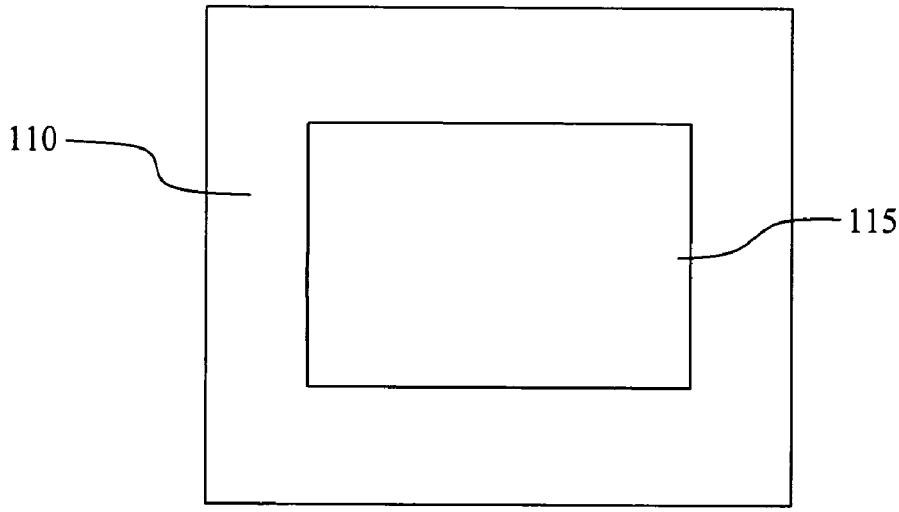
FIG. 1C is a top plan view of the magnetic core in accordance with the invention.
Figure 1D:
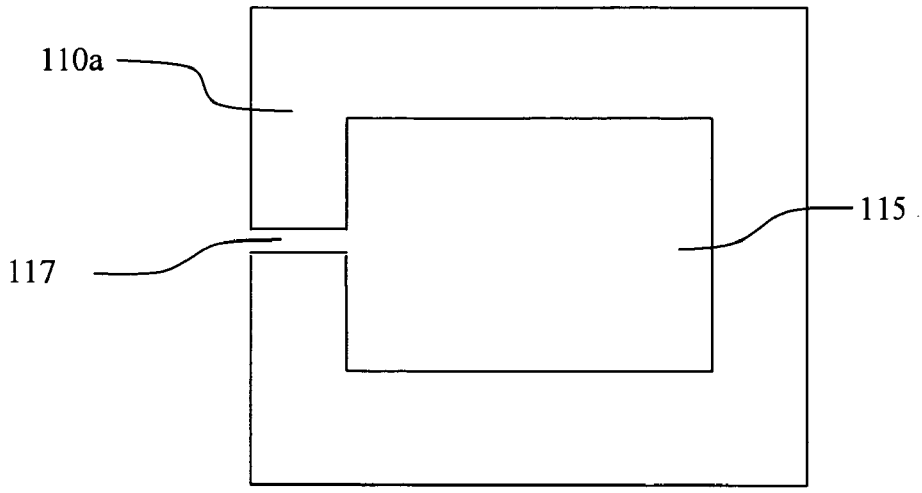
FIG. 1D is a top plan view of the magnetic core with a small gap in accordance with the invention.

With reference to FIG. 1D, a magnetic core 110*a* is shown including a small gap 117. The gap 117 can be used to adjust the properties of the magnetic core 110*a* with the resulting structure still providing a closed magnetic loop. The gap 117 can also be partial like a slot, in addition to extending completely through a side of the magnetic core. In all embodiments of this invention, a magnetic core either with or without a gap can be used.

Figure 1E:
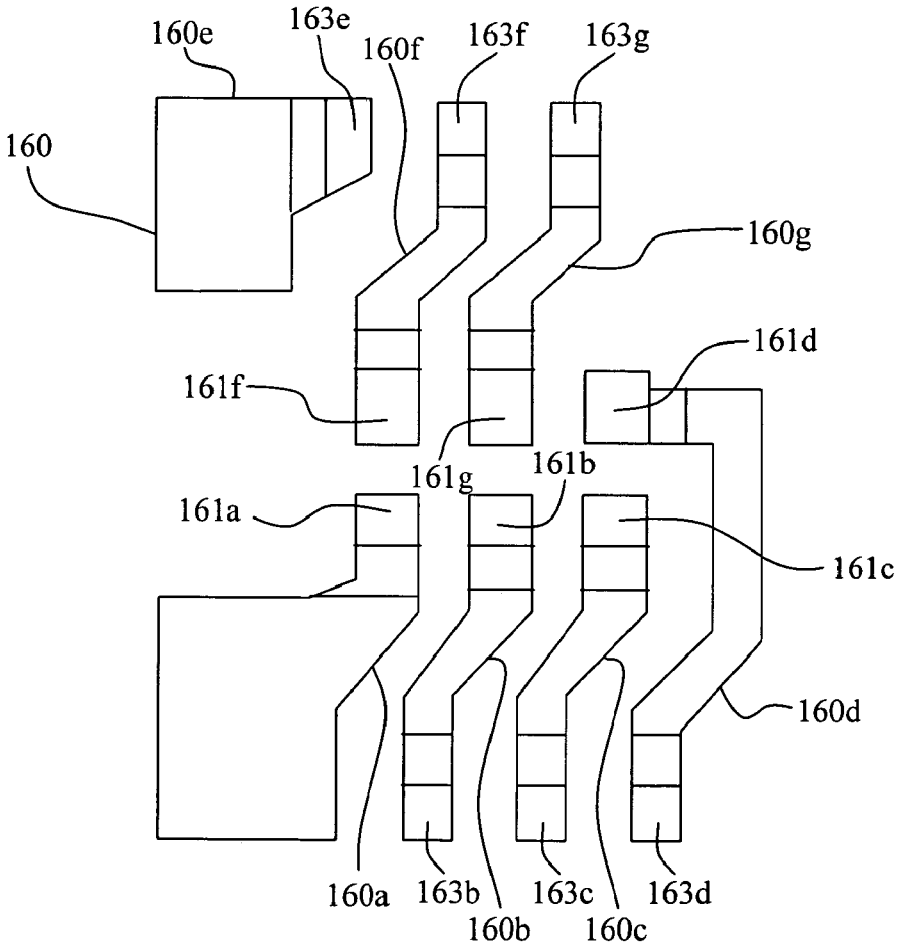
FIG. 1E is a top plan view of a bottom lead frame in accordance with the invention.

Top and bottom lead frames 120 and 160 each comprise a plurality of leads. With particular reference to FIG. 1E, the bottom lead frame 160 includes a first set of leads 160*a*, 160*b*, and 160*c* disposed on a first side of the lead frame 160. Leads 160*a*, 160*b* and 160*c* have a non-linear, stepped configuration to facilitate connection with leads of the top lead frame 120 to form the coil as further disclosed herein. The lead 160*a* serves as a terminal lead and has an inner contact section 161*a* disposed on a plane C-C parallel to, and above, a bottom plane A-A of the bottom lead frame 160. A simplified schematic side elevation view of the power inductor 100 is shown in FIG. 1G and illustrates the referenced planes and configuration of the leads. The lead 160*f* and parts of the magnetic core 110 are omitted from FIG. 1G to give a simplified and clearer illustration of the side profile of this embodiment. Similar simplifications are made in other side elevation views in this disclosure. Bottom leads 160*b* and 160*c* include inner contact sections 161*b* and 161*c* respectively disposed on the plane C-C that is parallel to, and above, a plane B-B of planar portions of the leads 160*b* and 160*c*. Bottom leads 160*b* and 160*c* further include outer contact sections 163*b* and 163*c* respectively disposed on the plane C-C. Plane B-B may be in the same plane or slightly above plane A-A.

The bottom lead frame 160 further includes a second set of leads 160*e*, 160*f* and 160*g* disposed on a second side of the lead frame 160. Leads 160*e*, 160*f* and 160*g* have a non-linear, stepped configuration to facilitate connection with leads of the top lead frame 120 to form the coil as further disclosed herein. The lead 160*e* serves as a terminal lead and has an outer contact section 163*e* disposed on the plane C-C. Bottom leads 160*f* and 160*g* include inner contact sections 161*f* and 161*g* respectively disposed on the plane C-C. Bottom leads 160*f* and 160*g* further include outer contact sections 163*f* and 163*g* respectively disposed on the plane C-C. The configuration of the leads of the bottom lead frame 160 provides a trough in which the magnetic core 110 is disposed in the assembled power inductor 100.

The bottom lead frame 160 also includes a routing lead 160*d* shown in FIG. 1E. Routing lead 160*d* includes an inner contact section 161*d* and an outer contact section 163*d* disposed on the plane C-C. A routing section 165*d* (disposed on the plane B-B) couples the outer contact section 163*d* disposed on the first side of the bottom lead frame 160 to the inner contact section 161*d* disposed on the second side of the bottom lead frame 160.

Figure 1F:
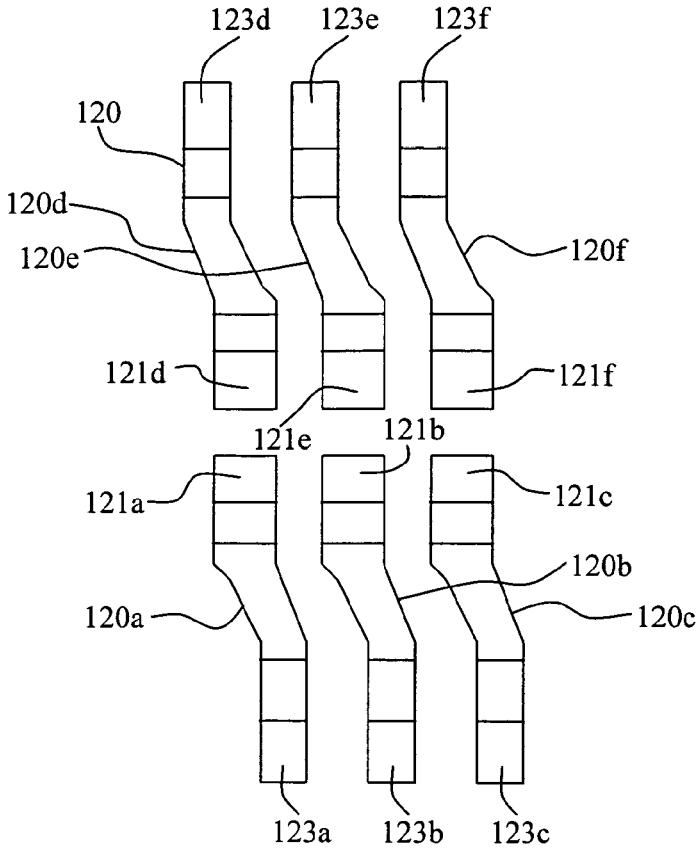
FIG. 1F is a top plan view of a top lead frame in accordance with the invention.
Figure 1G:
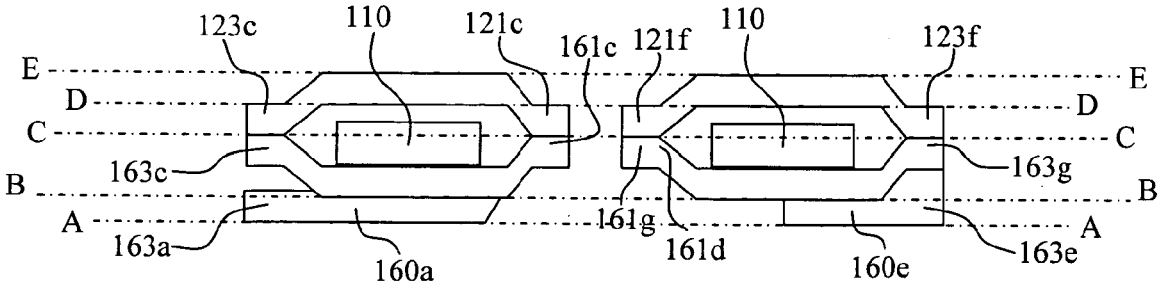
FIG. 1G is a side elevation view of the lead frame-based discrete power inductor of FIG. 1A.

With reference to FIG. 1F, the top lead frame 120 includes a first set of leads 120*a*, 120*b* and 120*c* disposed on a first side of the top lead frame 120. Top leads 120*a*, 120*b* and 120*c* have a non-linear, stepped configuration to facilitate connection with leads of the bottom lead frame 160 to form the coil as further disclosed herein. Top leads 120*a*, 120*b* and 120*c* include inner contact sections 121*a*, 121*b* and 121*c* respectively disposed on the plane D-D that is parallel to, and below, a plane E-E of planar portions of the top leads 120*a*, 120*b* and 120*c*. Top leads 120*a*, 120*b* and 120*c* further include outer contact sections 123*a*, 123*b* and 123*c* respectively disposed on the plane D-D.

Top lead frame 120 further includes a second set of leads 120*d*, 120*e* and 120*f* disposed on a second side of the top lead frame 120. Top leads 120*d*, 120*e* and 120*f* have a non-linear, stepped configuration to facilitate connection with leads of the bottom lead frame 160 to form the coil as further disclosed herein. Top leads 120*d*, 120*e* and 120*f* include inner contact sections 121*d*, 121*e* and 121*f* respectively disposed on the plane D-D. Top leads 120*d*, 120*e* and 120*f* further include outer contact sections 123*d*, 123*e* and 123*f* respectively disposed on the plane D-D. The configuration of the leads of the top lead frame 120 provides a cover to the trough formed by the leads of the bottom lead frame 160 in which the magnetic core 110 is disposed in the assembled power inductor 100. The connection about the magnetic core 110 of the leads of the top and bottom lead frames 120 and 160 respectively provides the coil.

The coil is formed around the magnetic core 110 as shown most clearly in FIG. 1B in which the magnetic core 110 is shown in phantom lines. The inner contact sections of the leads 160*a*, 160*b*, 160*c*, 160*d*, 160*f* and 160*g* of the bottom lead frame 160 are coupled to the inner contact sections 121*a*, 121*b*, 121*c*, 121*d*, 121*e* and 121*f* through the window 115 of the magnetic core 110. The outer contact sections of the leads 160*b*, 160*c*, 160*d*, 160*e*, 160*f* and 160*g* of the bottom lead frame 160 are coupled to the outer contact sections 123*a*, 123*b*, 123*c*, 123*d*, 123*e* and 123*f* of the top lead frame 120 around a periphery of the magnetic core 110.

The inner contact section 161*a* of the lead 160*a* is coupled to the inner contact section 121*a* of the lead 120*a*. The outer contact section 123*a* of the lead 120*a* is coupled to the outer contact section 163*b* of the adjacent lead 160*b*. The non-linear, stepped configuration of the lead 120*a* enables the alignment and coupling of the outer contact sections 123*a* and

163*b*. The inner contact section 161*b* of the lead 160*b* is coupled to the inner contact section 121*b* of the lead 120*b*. The non-linear, stepped configuration of the lead 160*b* is such that the inner contact section 161*b* of the lead 160*b* is disposed adjacent the inner contact section 161*a* within the window 115. The outer contact section 123*b* of the lead 120*b* is coupled to the outer contact section 163*c* of the adjacent lead 160*c*. As in the case of the lead 120*a*, the non-linear, stepped configuration of the lead 120*b* enables the alignment and coupling of the outer contact sections 123*b* and 163*c*. The inner contact section 161*c* of the lead 160*c* is coupled to the inner contact section 121*c* of the lead 120*c*. The non-linear, stepped configuration of the lead 160*c* is such that the inner contact section 161*c* of the lead 160*c* is disposed adjacent the inner contact section 161*b* within the window 115. The outer contact section 123*c* of the lead 120*c* is coupled to the outer contact section 163*d* of the adjacent lead 160*d*, the non-linear, stepped configuration of the lead 120*c* enabling the alignment and coupling of the outer contact sections 123*c* and 163*d*.

The routing section 165*d* of the routing lead 160*d* routes the coil circuit to connect the inner contact section 161*d* of the lead 160*d* to the inner contact section 121*f* of the lead 120*f*. The outer contact section 123*f* of the lead 120*f* is coupled to the outer contact section 163*g* of the adjacent lead 160*g*. The non-linear, stepped configuration of the lead 120*f* enables the alignment and coupling of the outer contact sections 123*f* and 163*g*. The inner contact section 161*g* of the lead 160*g* is coupled to the inner contact section 121*e* of the lead 120*e*. The non-linear, stepped configuration of the lead 160*g* is such that the inner contact section 161*g* of the lead 160*g* is disposed adjacent the inner contact section 161*d* within the window 115. The outer contact section 123*e* of the lead 120*e* is coupled to the outer contact section 163*f* of the adjacent lead 160*f*. The non-linear, stepped configuration of the lead 120*e* enables the alignment and coupling of the outer contact sections 123*e* and 163*f*. The inner contact section 161*f* of the lead 160*f* is coupled to the inner contact section 121*d* of the lead 120*d*. The non-linear, stepped configuration of the lead 160*f* is such that the inner contact section 161*f* of the lead 160*f* is disposed adjacent the inner contact section 161*g* within the window 115. The outer contact section 123*d* of the lead 120*d* is coupled to the outer contact section 161*e* of the adjacent terminal lead 160*e*.

The discrete power inductor 100 may include terminals 160*a* and 160*e*, the interconnection between the leads of the top and bottom lead frames 120 and 160 forming the coil about the magnetic core 110.

Figure 1H:
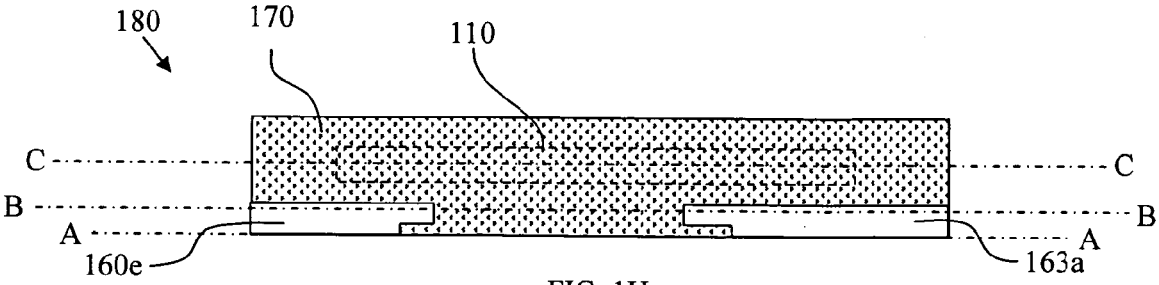
FIG. 1H is a cross sectional view of a package encapsulating the lead frame-based discrete power inductor of FIG. 1A.

The discrete power inductor 100 may be encapsulated with an encapsulant 170 to form a surface mount compatible package 180 (FIG. 1H). The encapsulant 170 may include conventional encapsulating materials. Alternatively, the encapsulant may include materials incorporating magnetic powders such as ferrite particles to provide shielding and improved magnetic performance. In case plane B-B is slightly above plane A-A, only portions of terminals 160*a* and 160*e* will exposed through the bottom surface of encapsulant 170 for outside connection and the rest of the bottom lead frame 160 may be covered by encapsulant 170.

Figure 2A:
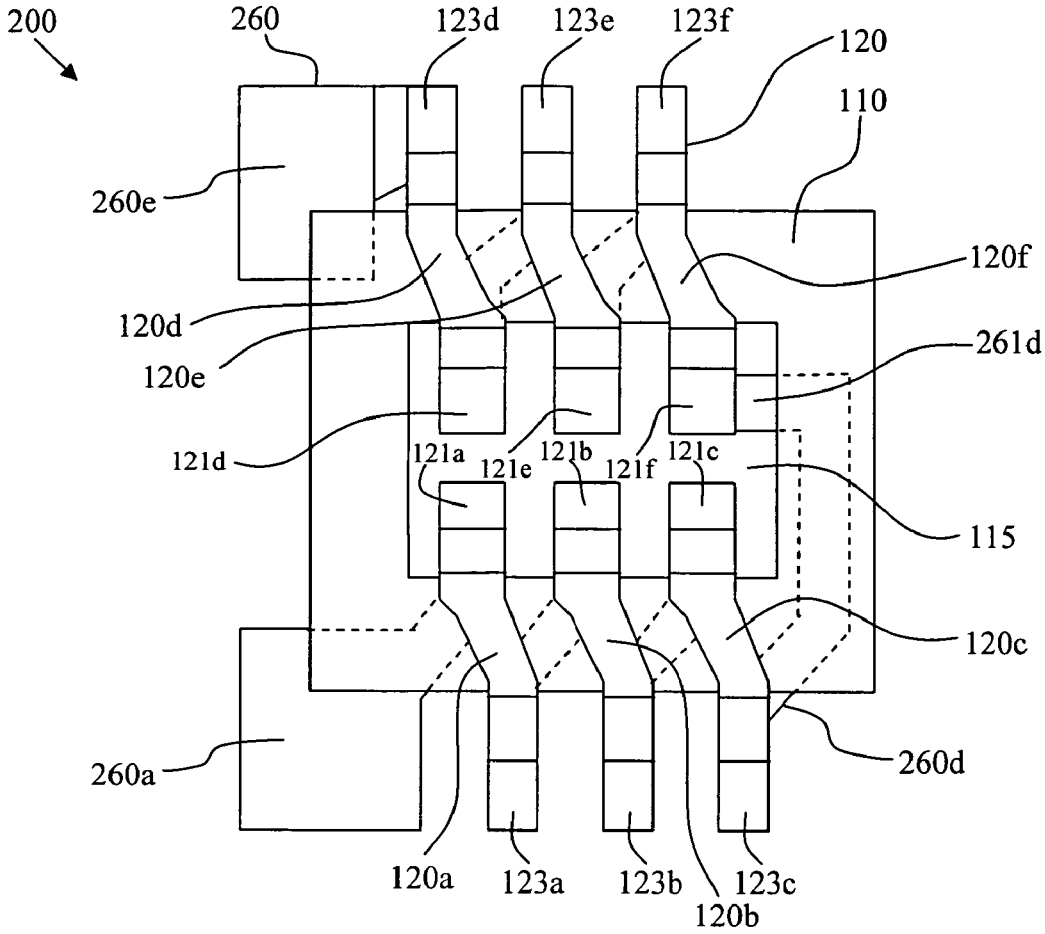
FIG. 2A is a top plan view of a second embodiment of the lead frame-based discrete power inductor in accordance with the invention.
Figure 2B:
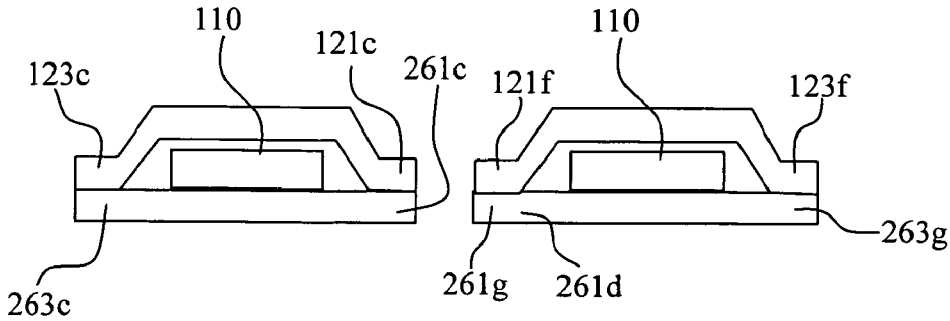
FIG. 2B is a side elevation view of the lead frame-based discrete power inductor of FIG. 2A.

A second embodiment of a lead frame-based discrete power inductor generally designated 200 is shown in FIG. 2A wherein portions of the leads of the bottom lead frame 260 are shown in phantom lines. The power inductor 200 is in all respects identical to the power inductor 100 with the exception that the bottom lead frame 260 is planar as shown in the simplified schematic side elevation view (FIG. 2B) of the power inductor 200.

Figure 2C:
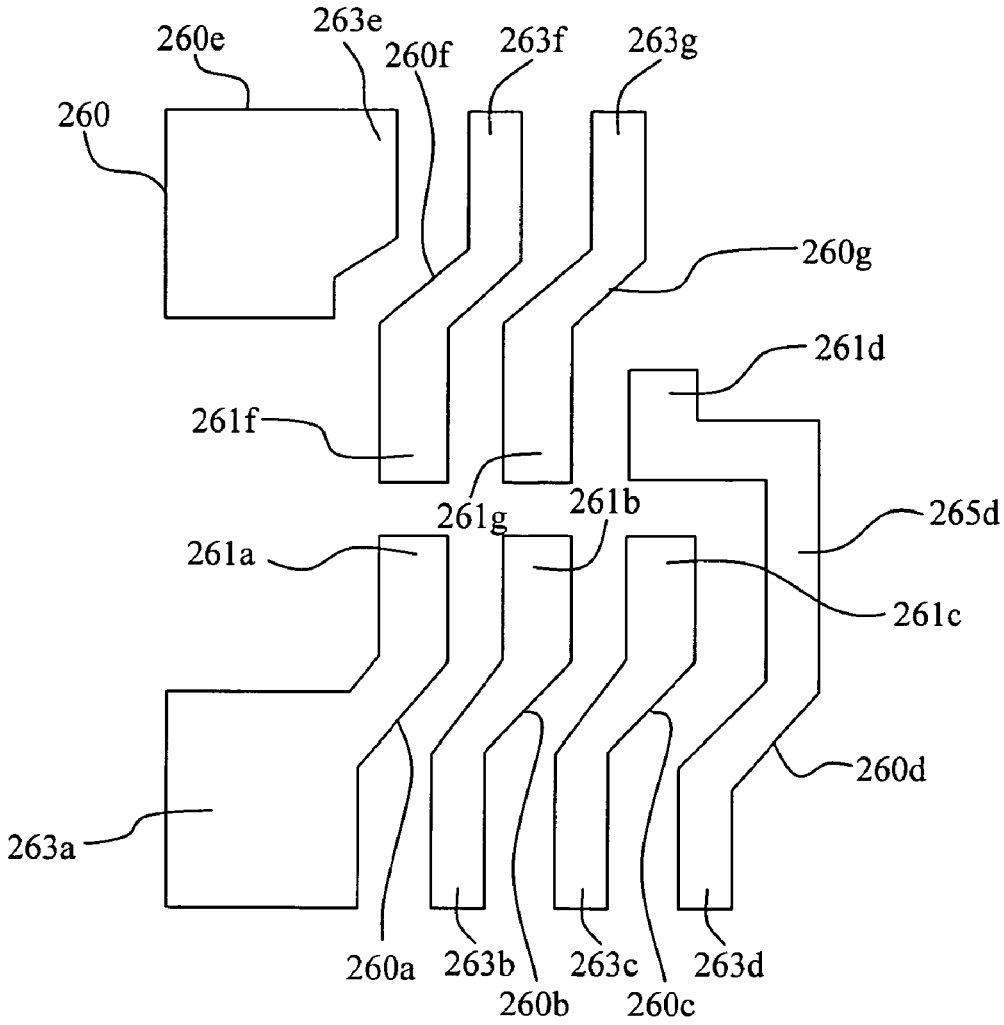
FIG. 2C is a top plan view of a bottom lead frame in accordance with the invention.

With particular reference to FIG. 2C, the bottom lead frame 260 includes a first set of leads 260*a*, 260*b* and 260*c* disposed on a first side of the lead frame 260. Leads 260*a*, 260*b* and 260*c* have a non-linear, stepped configuration to facilitate connection with leads of the top lead frame 120 to form the coil as further disclosed herein. The lead 260*a* serves as a terminal lead and has an inner contact section 261*a*. Bottom leads 260*b* and 260*c* include inner contact sections 261*b* and 261*c* respectively. Bottom leads 160*b* and 160*c* further include outer contact sections 163*b* and 163*c* respectively.

The bottom lead frame 260 further includes a second set of leads 260*e*, 260*f* and 260*g* disposed on a second side of the lead frame 260. Leads 260*e*, 260*f* and 260*g* have a non-linear, stepped configuration to facilitate connection with leads of the top lead frame 120 to form the coil as further disclosed herein. The lead 260*e* serves as a terminal lead and has an outer contact section 263*e*. Bottom leads 260*f* and 260*g* include inner contact sections 261*f* and 261*g* respectively. Bottom leads 260*f* and 260*g* further include outer contact sections 263*f* and 263*g* respectively. The configuration of the leads of the bottom lead frame 260 provides a platform on which the magnetic core 110 is disposed in the assembled power inductor 200.

The bottom lead frame 260 also includes a routing lead 260*d* shown in FIG. 2C. Routing lead 260*d* includes an inner contact section 261*d* and an outer contact section 263*d*. A routing section 265*d* couples the outer contact section 263*d* disposed on the first side of the bottom lead frame 260 to the inner contact section 261*d* disposed on the second side of the bottom lead frame 260.

A coil is formed about the magnetic core 110 as shown in FIG. 2A. The inner contact sections of the leads 260*a*, 260*b*, 260*c*, 260*d*, 260*f* and 260*g* of the bottom lead frame 260 are coupled to the inner contact sections 121*a*, 121*b*, 121*c*, 121*d*, 121*e* and 121*f* through the window 115 of the magnetic core 110. The outer contact sections of the leads 260*b*, 260*c*, 260*d*, 260*e*, 260*f* and 260*g* of the bottom lead frame 260 are coupled to the outer contact sections 123*a*, 123*b*, 123*c*, 123*d*, 123*e* and 123*f* of the top lead frame 120 around a periphery of the magnetic core 110.

The inner contact section 261*a* of the lead 260*a* is coupled to the inner contact section 121*a* of the lead 120*a*. The outer section 123*a* of the lead 120*a* is coupled to the outer section 263*b* of the adjacent lead 260*b*. The non-linear, stepped configuration of the lead 120*a* enables the alignment and coupling of the outer contact sections 123*a* and 263*b*. The inner contact section 261*b* of the lead 260*b* is coupled to the inner contact section 121*b* of the lead 120*b*. The non-linear, stepped configuration of the lead 260*b* is such that the inner contact section 261*b* of the lead 260*b* is disposed adjacent the inner contact section 261*a* within the window 115. The outer contact section 123*b* of the lead 120*b* is coupled to the outer contact section 263*c* of the adjacent lead 260*c*. The non-linear, stepped configuration of the lead 120*b* enables the alignment and coupling of the outer contact sections 123*b* and 263*c*. The inner contact section 261*c* of the lead 260*c* is coupled to the inner section 121*c* of the lead 120*c*. The non-linear, stepped configuration of the lead 260*c* is such that the inner contact section 261*c* of the lead 260*c* is disposed adjacent the inner contact section 261*b* within the window 115. The outer contact section 123*c* of the lead 120*c* is coupled to the outer contact section 263*d* of the adjacent lead 260*d*.

The routing lead 260*d* comprises a routing section 265*d* (FIG. 2C) that routes the coil circuit to connect the inner contact section 261*d* of the lead 260*d* to the inner contact section 121*f* of the lead 120*f*. The outer contact section 123*f* of the lead 120*f* is coupled to the outer contact section 263*g* of the lead 260*g*. The non-linear, stepped configuration of the lead 120*f* enables the alignment and coupling of the outer contact sections 123*f* and 263*g*. The inner contact section 261*g* of the lead 260*g* is coupled to the inner contact section 121*e* of the adjacent lead 121*e*. The non-linear, stepped configuration of the lead 260*g* is such that the inner contact section 261*g* of the lead 260*g* is disposed adjacent the inner contact section 261*d* within the window 115. The outer contact section 123*e* of the lead 120*e* is coupled to the outer contact section 263*f* of the adjacent lead 260*f*. The non-linear, stepped configuration of the lead 120*e* enables the alignment and coupling of the outer contact sections 123*e* and 263*f*. The inner contact section 261*f* of the lead 260*f* is coupled to the inner contact section 121*d* of the lead 120*d*. The non-linear, stepped configuration of the lead 260*f* is such that the inner contact section 261*f* of the lead 260*f* is disposed adjacent the inner contact section 261*g* within the window 115. The outer contact section 123*d* of the lead 120*d* is coupled to the out contact section 263 of lead 260*e*.

The discrete power inductor 200 may include terminals 260*a* and 260*e*, the interconnection between the leads of the top and bottom lead frames 120 and 260 forming the coil about the magnetic core 110.

Figure 2D:
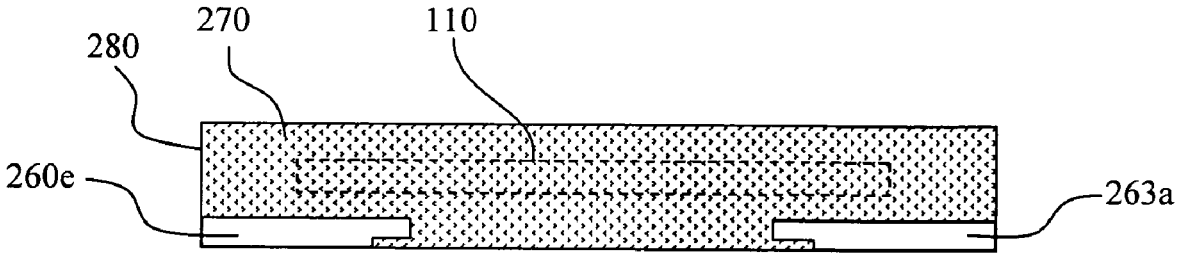
FIG. 2D is a cross sectional view of a package encapsulating the lead frame-based discrete power inductor of FIG. 2A.

The discrete power inductor 200 may be encapsulated with an encapsulant 270 to form a package 280 (FIG. 2D). The encapsulant 270 may include conventional encapsulating materials. Alternatively, the encapsulant may include materials incorporating magnetic powders such as ferrite particles to provide shielding and improved magnetic performance.

Figure 3A:
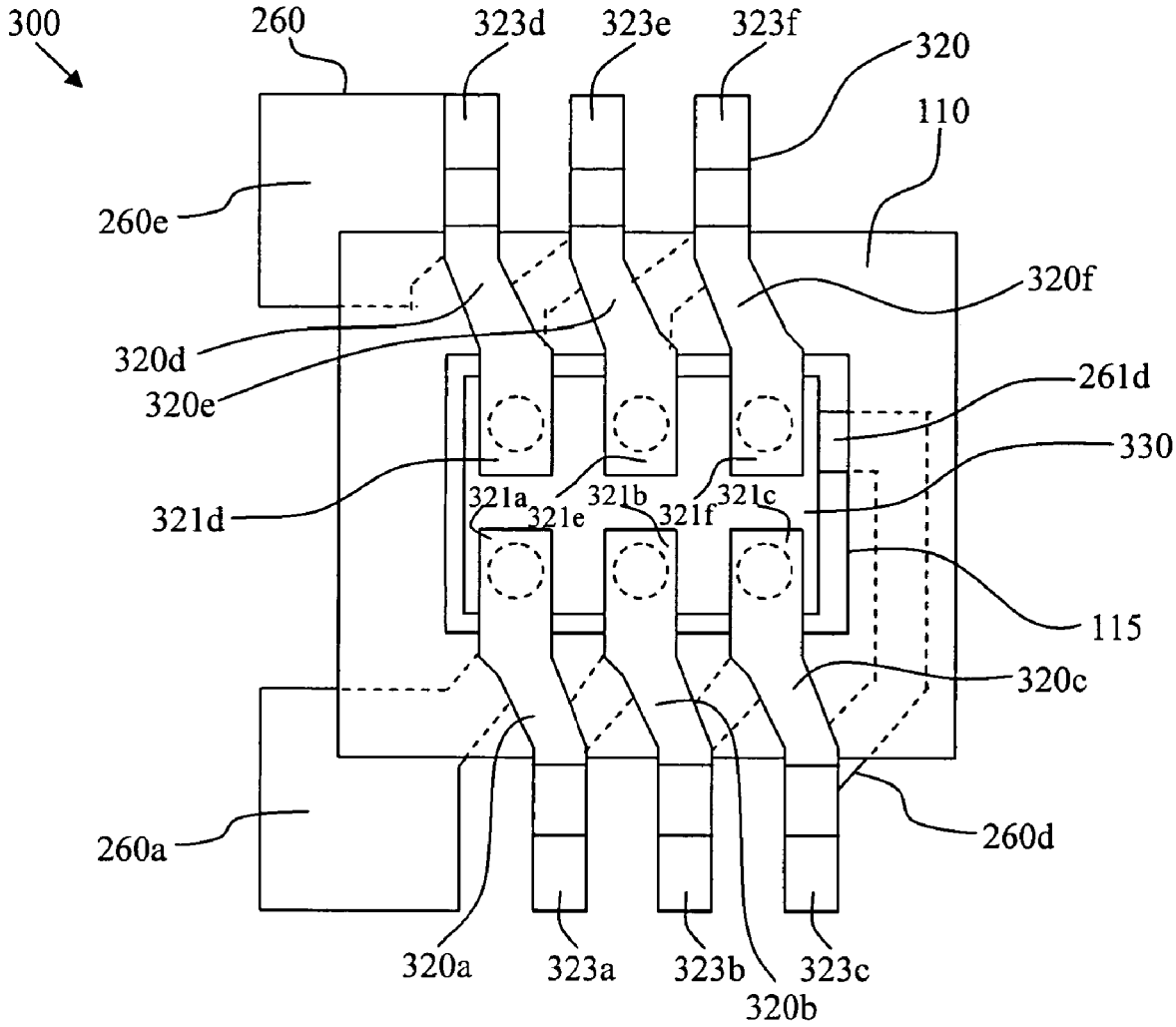
FIG. 3A is a top plan view of a third embodiment of the lead frame-based discrete power inductor in accordance with the invention.

A third embodiment of a lead frame-based discrete power inductor generally designated 300 is shown in FIG. 3A wherein portions of the leads of the bottom lead frame 260 are shown in phantom lines. Power inductor 300 comprises the planar bottom lead frame 260, a top lead frame 320, the leads of which are interconnected about the magnetic core 110. An interconnection chip 330 is disposed in the window 115 (FIG. 3C) and enables connection between the inner contact sections of the top and bottom lead frame leads.

Figure 3B:
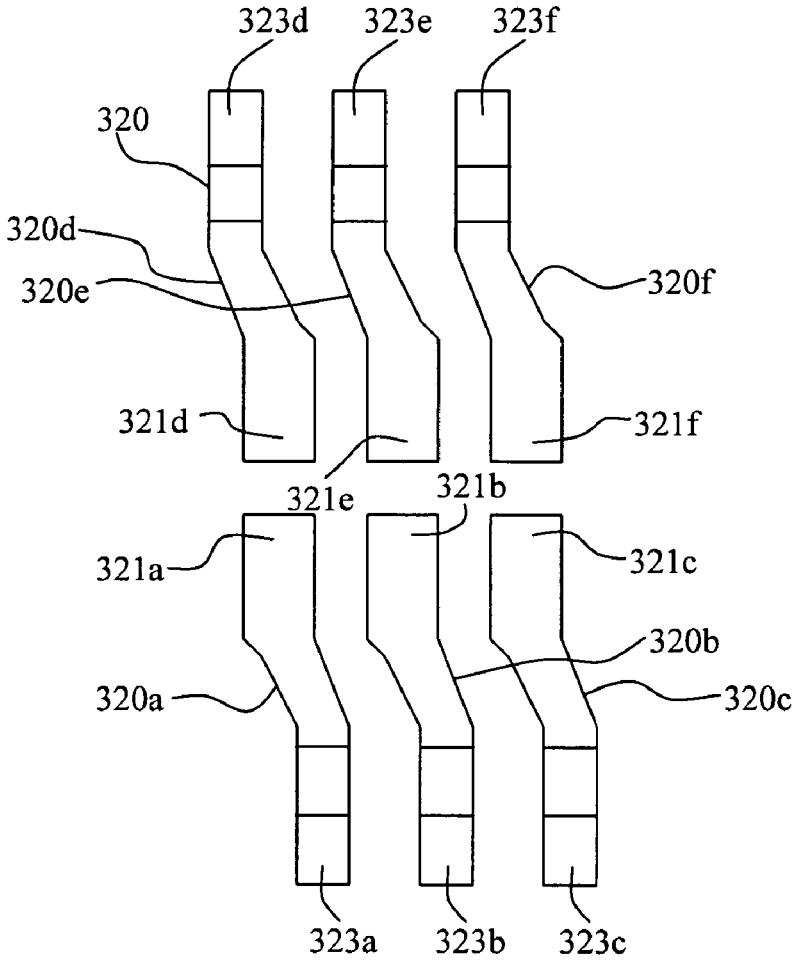
FIG. 3B is a top plan view of a top lead frame in accordance with the invention.
Figure 3C:
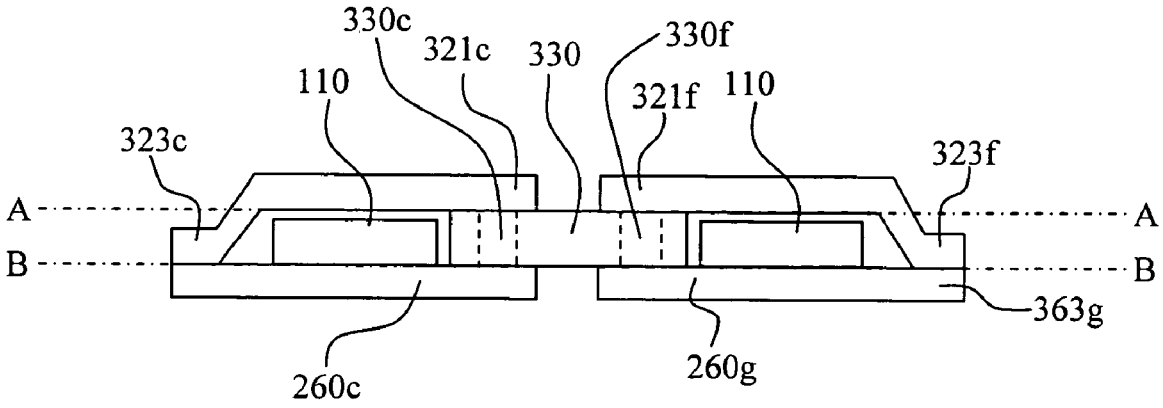
FIG. 3C is a schematic side elevation view a the lead frame-based discrete power inductor of FIG. 3A.

With reference to FIG. 3B, the top lead frame 320 includes a first set of leads 320*a*, 320*b* and 320*c* disposed on a first side of the top lead frame 120. Top leads 320*a*, 320*b* and 320*c* have a non-linear, stepped configuration to facilitate connection with leads of the bottom lead frame 260 to form the coil as further disclosed herein. Top leads 320*a*, 320*b* and 320*c* include inner contact sections 321*a*, 321*b* and 321*c* respectively disposed on a plane A-A of planar portions of the top leads 320*a*, 320*b* and 320*c*. Top leads 320*a*, 320*b* and 320*c* further include outer contact sections 323*a*, 323*b* and 323*c* respectively disposed on a plane B-B parallel, and below the plane A-A.

Top lead frame 320 further includes a second set of leads 320*d*, 320*e* and 320*f* disposed on a second side of the top lead frame 320. Top leads 320*d*, 320*e* and 320*f* have a non-linear, stepped configuration to facilitate connection with leads of the bottom lead frame 260 to form the coil as further disclosed herein. Top leads 320*d*, 320*e* and 320*f* include inner contact sections 321*d*, 321*e* and 321*f* respectively disposed on the A-A. Top leads 320*d*, 320*e* and 320*f* further include outer contact sections 323*d*, 323*e* and 323*f* respectively disposed on the plane B-B. The connection about the magnetic core 110 of the leads of the top and bottom lead frames 320 and 260 respectively provides the coil.

Figure 3D:
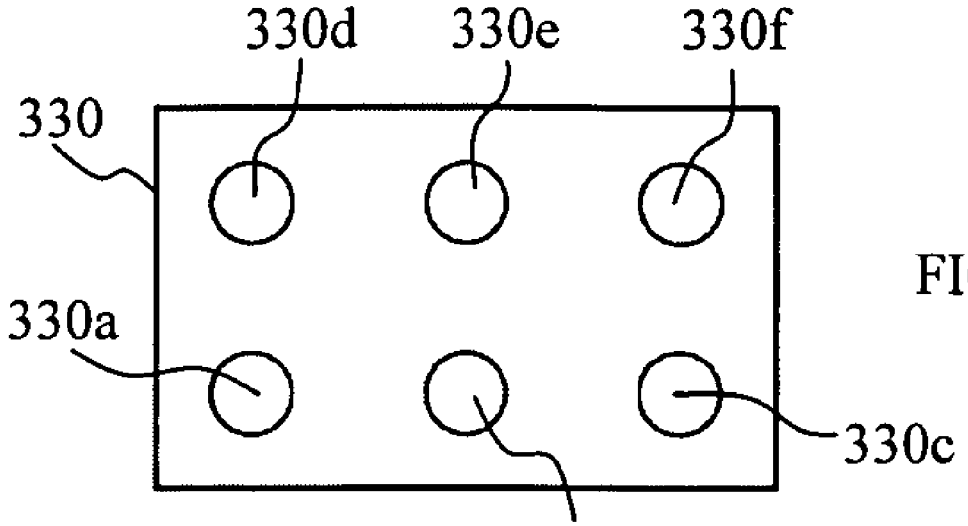
FIG. 3D is a top plan view of an interconnection chip in accordance with the invention.
Figure 3E:
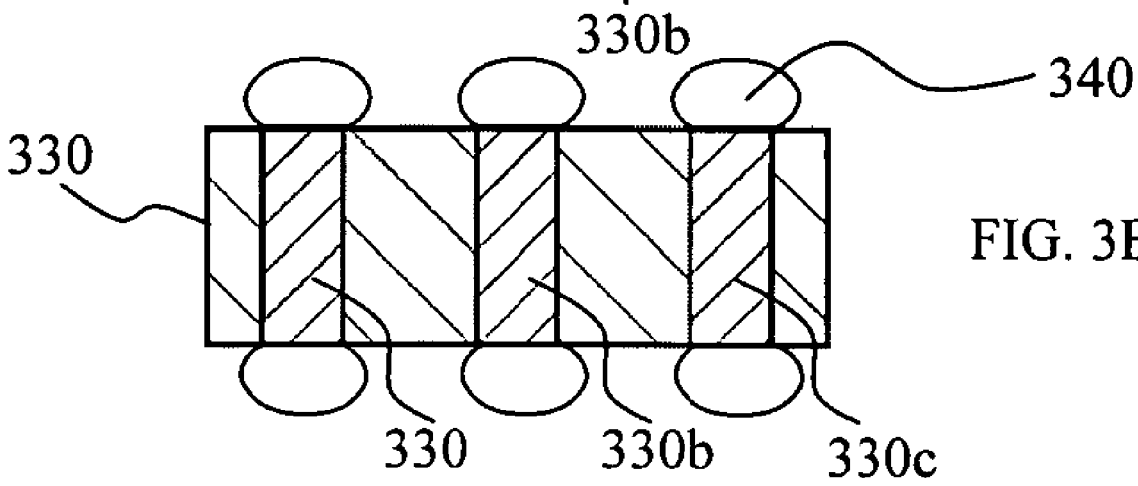
FIG. 3E is a cross sectional view of the interconnection chip of FIG. 3D.

The interconnection chip 330 is shown in FIG. 3D and FIG. 3E and includes six conductive through vias 330*a*, 330*b*, 330*c*, 330*d*, 330*e* and 330*f* (shown in phantom lines in FIG. 3A) spaced and configured to provide interconnection between the inner contact sections of the leads of the top lead frame 320 and the bottom lead frame 260. Solder bumps 340 are preferably formed on top and bottom surfaces of the interconnection chip 330 to facilitate interconnection.

A coil is formed about the magnetic core 110 as shown in FIG. 3A. The inner contact sections of the leads 260*a*, 260*b*, 260*c*, 260*d*, 260*f* and 260*g* of the bottom lead frame 260 are coupled to the inner contact sections 321*a*, 321*b*, 321*c*, 321*d*, 321*e* and 321*f* of the top lead frame 320 by means of the interconnection chip 330. The outer contact sections of the leads 260*b*, 260*c*, 260*d*, 260*e*, 260*f* and 260*g* of the bottom lead frame 260 are coupled to the outer contact sections 323*a*, 323*b*, 323*c*, 323*d*, 323*e* and 323*f* of the top lead frame 320 around a periphery of the magnetic core 110.

The inner contact section 261*a* of the lead 260*a* is coupled to the inner contact section 321*a* of the lead 320*a* by means of via 330*a*. The outer contact section 323*a* of the lead 320*a* is coupled to the outer contact section 263*b* of the adjacent lead 260*b*. The inner contact section 261*b* of the lead 260*b* is coupled to the inner contact section 321*b* of the lead 320*b* by means of via 330*b*. The outer contact section 323*b* of the lead 320*b* is coupled to the outer contact section 263*c* of the adjacent lead 260*c*. The inner contact section 261*c* of the lead 260*c* is coupled to the inner contact section 321*c* of the lead 320*c* by means of via 330*c*. The outer contact section 322*c* of the lead 320*c* is coupled to the outer contact section 263*d* of the adjacent lead 260*d*. The routing section 265*d* (FIG. 2C) routes the coil circuit to connect the inner contact section 261*d* of the lead 260*d* to the inner contact section 321*f* of the lead 320*f* by means of via 330*f*. The outer contact section 323*f* of the lead 320*f* is coupled to the outer contact section 263*g* of the adjacent lead 260*g*. The inner contact section 261*g* of the lead 260*g* is coupled to the inner contact section 321*e* of the lead 320*e* by means of via 330*e*. The outer contact section 323*e* of the lead 320*e* is coupled to the outer contact section 263*f* of the adjacent lead 260*f*. The inner contact section 261*f* of the lead 260*f* is coupled to the inner contact section 321*d* of the lead 320*d* by means of via 330*d*. The outer contact section 323*d* of the lead 320*d* is coupled to the outer contact section 263*e* of the adjacent lead 260*e*. As in the first and second embodiments, the non-linear, stepped configurations of the top and bottom lead frame leads provide for alignment and spacing of the inner and outer contact sections.

The discrete power inductor 300 may include terminals 260*a* and 260*e*, the interconnection between the leads of the top and bottom lead frames 320 and 260 facilitated by the interconnection chip 330 forming the coil about the magnetic core 110.

The discrete power inductor 300 may be encapsulated with an encapsulant to form a package (not shown). The encapsulant may include conventional encapsulating materials. Alternatively, the encapsulant may include materials incorporating magnetic powders such as ferrite particles to provide shielding and improved magnetic performance.

Figure 4A:
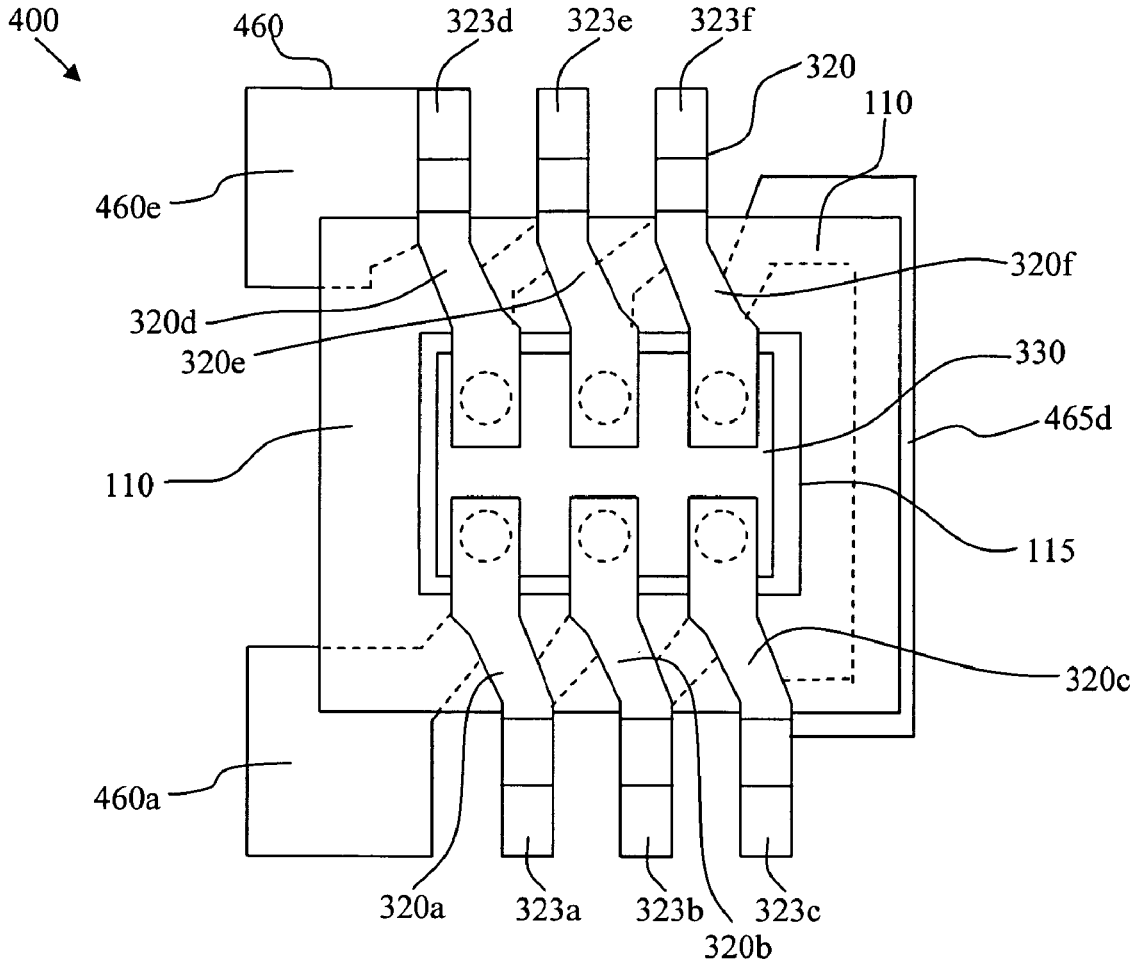
FIG. 4A is a top plan view of a fourth embodiment of the lead frame-based discrete power inductor in accordance with the invention.
Figure 4B:
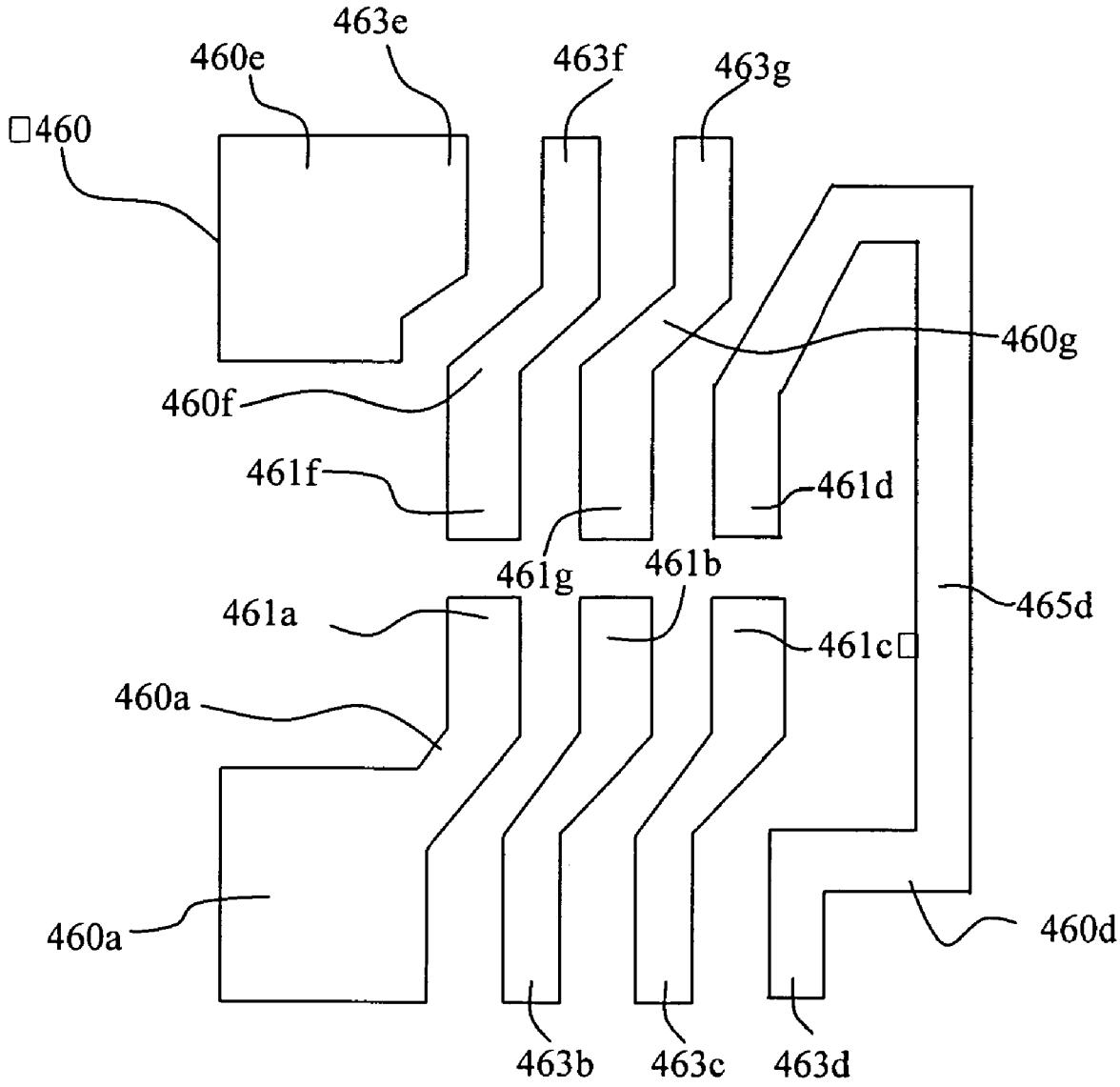
FIG. 4B is a top plan view of a bottom lead frame in accordance with the invention.

A fourth embodiment of a lead frame-based discrete power inductor generally designated 400 is shown in FIG. 4A wherein portions of the leads of a bottom lead frame 460 are shown in phantom lines. The power inductor 400 is in all respects identical to the power inductor 300 with the exception that the bottom lead frame 460 (FIG. 4B) comprises a routing lead 460*d* having a routing section 465*d* terminating in an inner section 461*d* aligned in parallel with an inner section 461*g* of a lead 460*g*.

Figure 5A:
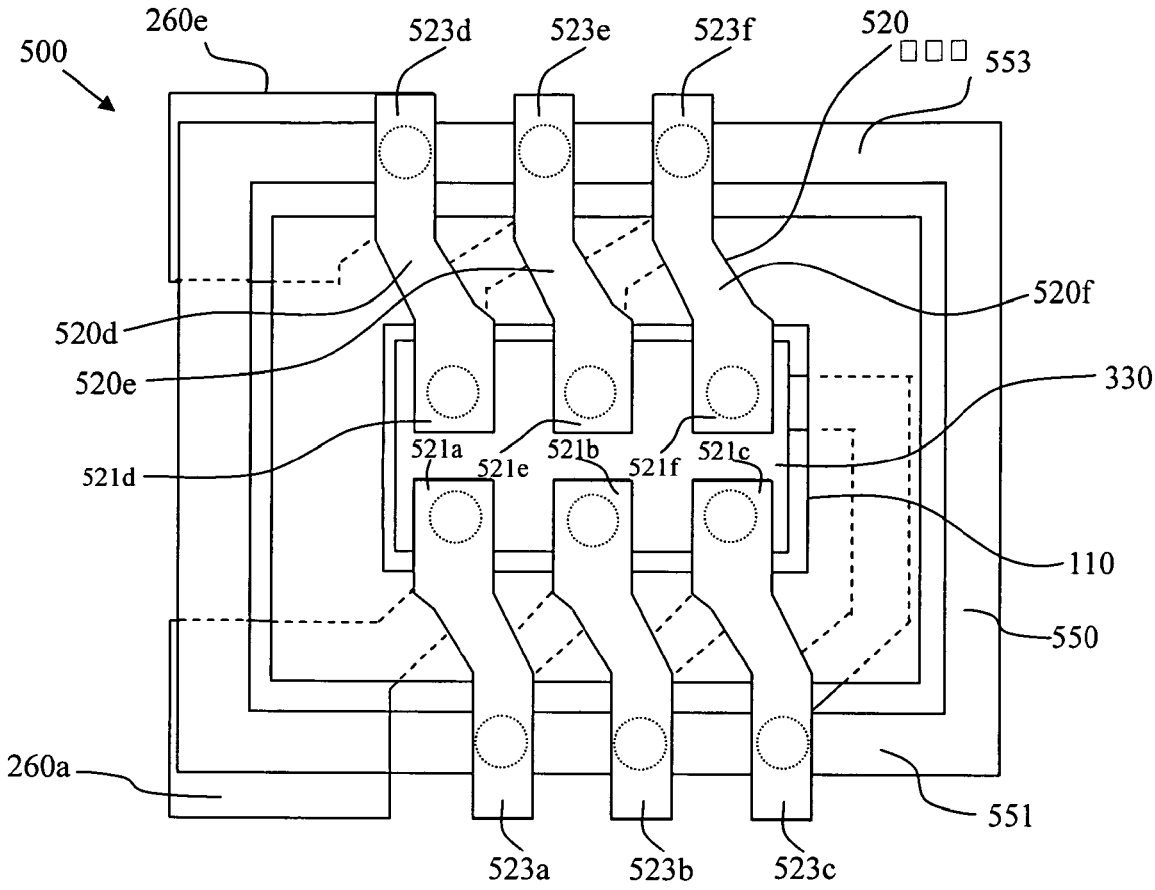
FIG. 5A is a top plan view of a fifth embodiment of the lead frame-based discrete power inductor in accordance with the invention.
Figure 5B:
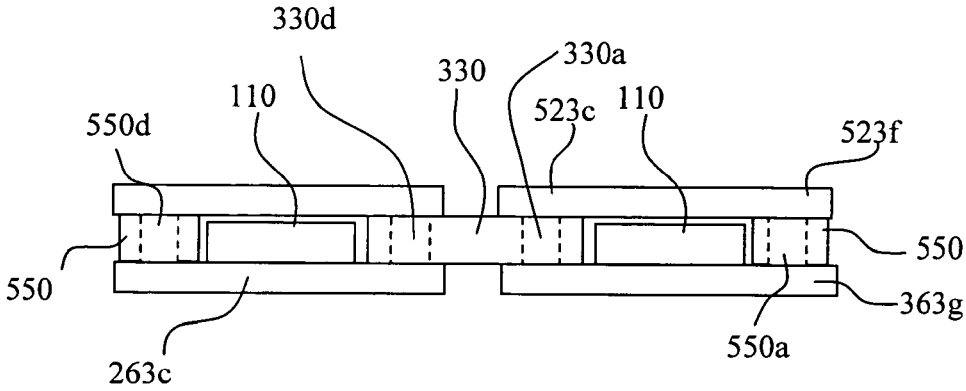
FIG. 5B is a schematic side elevation view of the lead frame-based discrete power inductor of FIG. 5A.
Figure 5C:
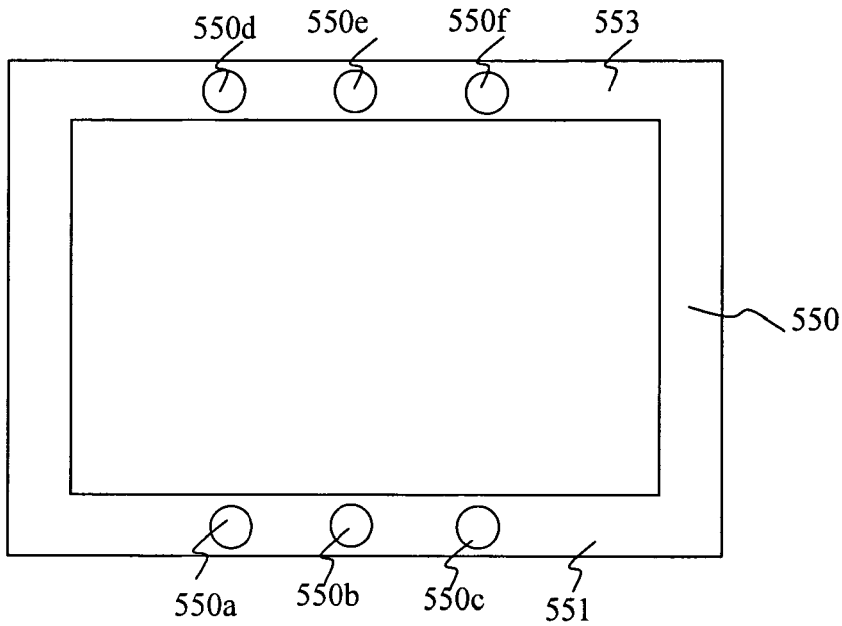
FIG. 5C is a top plan view of a peripheral interconnection chip in accordance with the invention.

A fifth embodiment of a lead frame-based discrete power inductor generally designated 500 is shown in FIG. 5A and FIG. 5B wherein portions of the leads of the bottom lead frame 260 are shown in phantom lines. The power inductor 500 comprises a magnetic core 110, a top lead frame 520

Figure 5D:
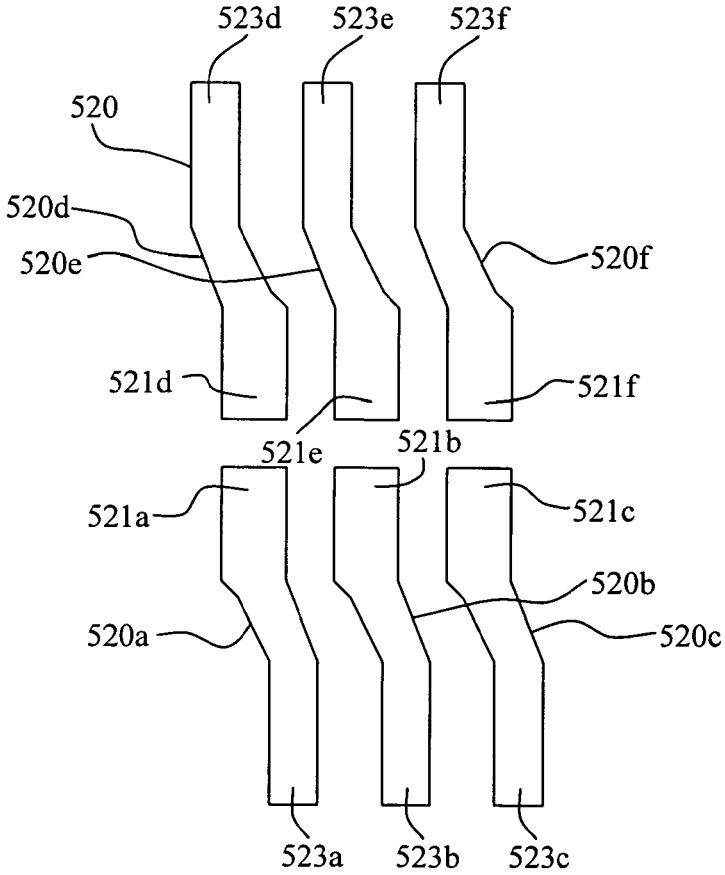
FIG. 5D is a top plan view of a top lead frame in accordance with the invention.

(FIG. 5D), and the bottom lead frame 260, the leads of which are interconnected about the magnetic core 110. The interconnection chip 330 is disposed in the window 115 (FIG. 3C) and enables connection between the inner contact sections of the top and bottom lead frame leads. A peripheral interconnection chip 550 enables connection between the outer contact sections of the top and bottom lead frame leads.

The top lead frame 520 comprises a planar lead frame comprising a first set of leads 520*a*, 520*b* and 520*c* disposed on a first side of the lead frame 520. A second set of leads 520*d*, 520*e* and 520*f* are disposed on a second side of the lead frame. Lead 520*a* includes an inner contact section 121*a* and an outer contact section 123*a*. Lead 120*b* includes an inner contact section 121*b* and an outer contact section 123*b*. Lead 120*d* includes an inner contact section 121*d* and an outer contact section 123*d*. Lead 120*e* includes an inner contact section 121*e* and an outer contact section 123*e*. Lead 120*f* includes an inner contact section 121*f* and an outer contact section 123*f*. Top leads 520*a*, 520*b*, 520*c*, 520*d*, 520*e* and 520*f* have a non-linear, stepped configuration to facilitate connection with leads of the bottom lead frame 260 to form the coil as previously described.

The peripheral interconnection chip 550 comprises a rectangular shaped structure having conductive through vias 550*a*, 550*b*, 550*c*, 550*d*, 550*e* and 550*f*. Vias 550*a*, 550*b* and 550*c* are disposed in spaced relationship along a first section 551 of the peripheral interconnection chip 550. Vias 550*d*, 550*e* and 550*f* are disposed in spaced relationship along a second section 553 of the peripheral interconnection chip 550. The vias 550*a*, 550*b*, 550*c*, 550*d*, 550*e* and 550*f* are spaced and configured to provide interconnection between the outer contact sections of the leads of the top lead frame 520 and the bottom lead frame 260.

A coil is formed about the magnetic core 110 as shown in FIG. 5A. An inner contact section 261*a* of the lead 260*a* is coupled to the inner contact section 521*a* of the lead 520*a* by means of via 330*a*. The outer contact section 523*a* of the lead 520*a* is coupled to the outer contact section 263*b* of the adjacent lead 260*b* by means of via 550*a*. The inner contact section 261*b* of the lead 260*b* is coupled to the inner contact section 521*b* of the lead 520*b* by means of via 330*b*. The outer contact section 523*b* of the lead 520*b* is coupled to the outer contact section 263*c* of the adjacent lead 260*c* by means of via 550*b*. The inner contact section 261*c* of the lead 260*c* is coupled to the inner contact section 521*c* of the lead 520*c* by means of via 330*c*. The outer contact section 523*c* of the lead 520*c* is coupled to the outer contact section 263*d* of the adjacent lead 260*d* by means of via 550*c*. The routing section 265*d* (FIG. 2C) routes the coil circuit to connect the inner contact section 261*d* of the lead 260*d* to the inner contact section 521*f* of the lead 520*f* by means of via 330*f*. The outer contact section 523*f* of the lead 520*f* is coupled to the outer contact section 263*g* of the adjacent lead 260*g* by means of via 550*f*. The inner contact section 261*g* of the lead 260*g* is coupled to the inner contact section 521*e* of the lead 520*e* by means of via 330*e*. The outer contact section 523*e* of the lead 520*e* is coupled to the outer contact section 263*f* of the adjacent lead 260*f* by means of via 550*e*. The inner contact section 261*f* of the lead 260*f* is coupled to the inner contact section 521*d* of the lead 520*d* by means of via 330*d*. The outer contact section 523*d* of the lead 520*d* is coupled to the outer contact section 263*e* of the adjacent lead 260*e* by means of via 550*d*. As in the previously described embodiments, the non-linear, stepped configurations of the top and bottom lead frame leads provide for alignment and spacing of the inner and outer contact sections.

The discrete power inductor 500 may include terminals 260*a* and 260*e*, the interconnection between the leads of the top and bottom lead frames 520 and 260 facilitated by the interconnection chip 330 and the peripheral interconnection chip 550 forming the coil about the magnetic core 110.

The discrete power inductor 500 may be encapsulated with an encapsulant to form a package (not shown). The encapsulant may include conventional encapsulating materials. Alternatively, the encapsulant may include materials incorporating magnetic powders such as ferrite particles to provide shielding and improved magnetic performance.

Figure 6A:
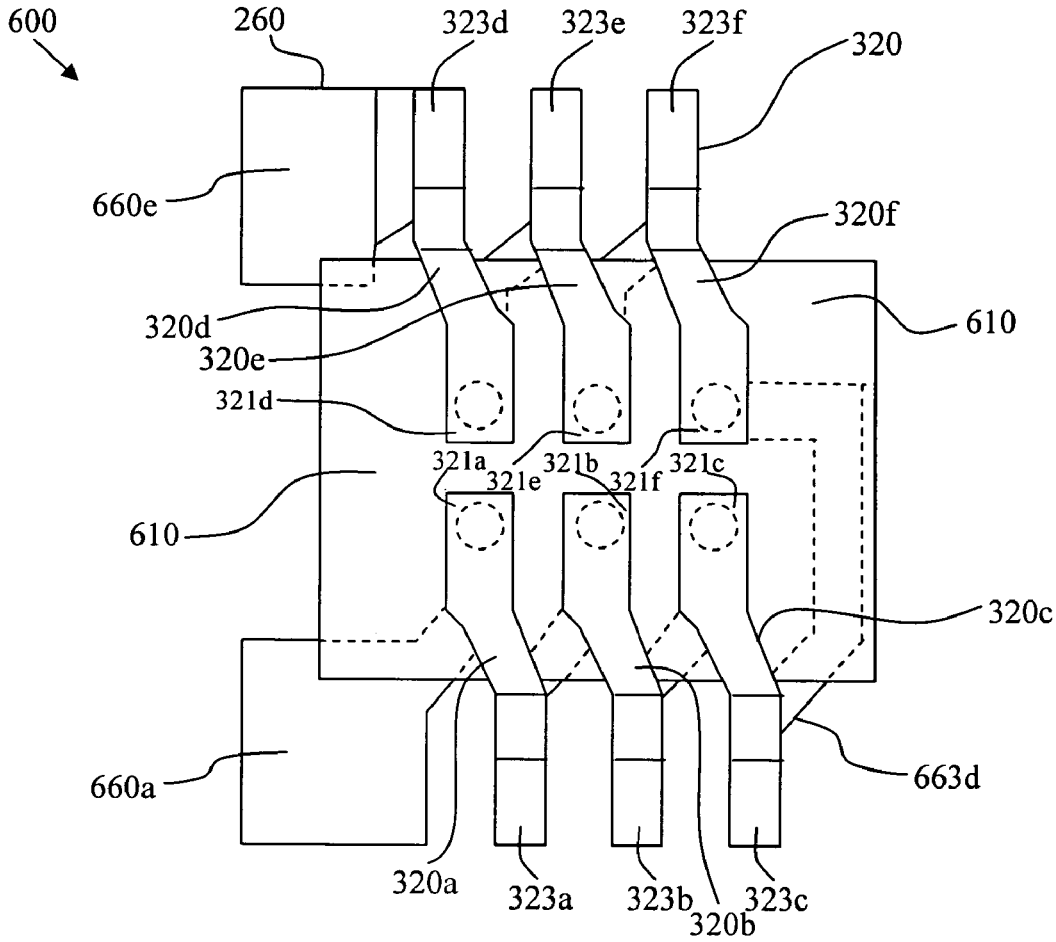
FIG. 6A is a top plan view of a sixth embodiment of the lead frame-based discrete power inductor in accordance with the invention.
Figure 6B:
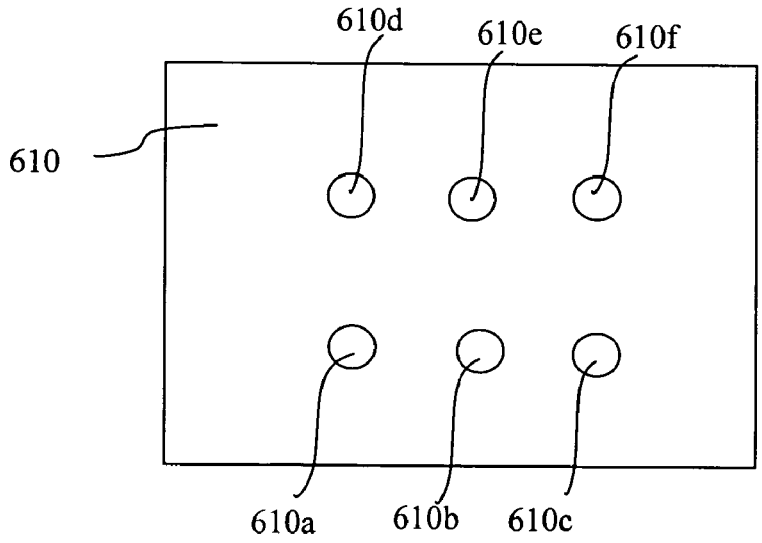
FIG. 6B is a top plan view of a magnetic core in accordance with the invention.

A sixth embodiment of a lead frame-based discrete power inductor generally designated 600 is shown in FIG. 6A wherein portions of the leads of a bottom lead frame 660 are shown in phantom lines. The power inductor 600 comprises a magnetic core 610, the top lead frame 320 and the bottom lead frame 660, the leads of which are interconnected about the magnetic core 610. The magnetic core 610 includes six conductive through vias 610*a*, 610*b*, 610*c*, 610*d*, 610*e* and 610*f* (shown in phantom lines in FIG. 6A) spaced and configured to provide interconnection between the inner contact sections of the leads of the top lead frame 320 and the bottom lead frame 660.

Figure 6C:
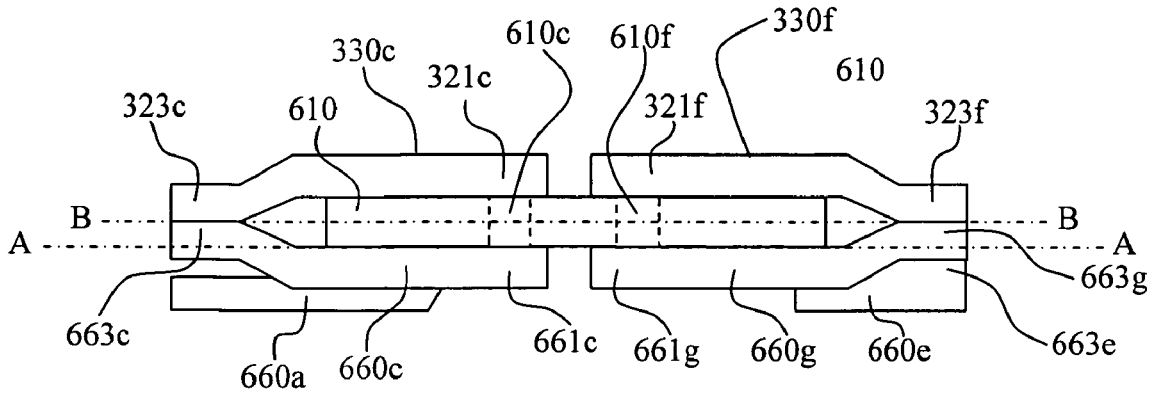
FIG. 6C is a side elevation view of the lead frame-based discrete power inductor of FIG. 6A.
Figure 6D:
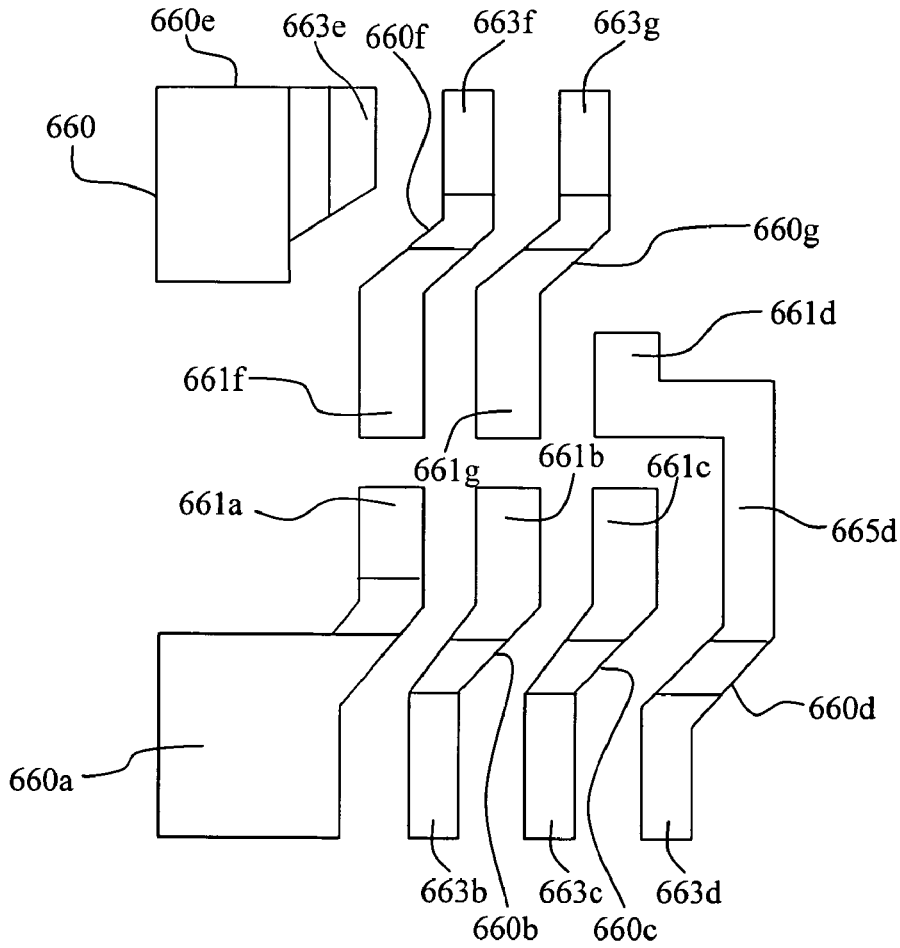
FIG. 6D is a top plan view of a bottom lead frame in accordance with the invention.

With particular reference to FIG. 6D, the bottom lead frame 660 includes a first set of leads 660*a*, 660*b* and 660*c* disposed on a first side of the lead frame 660 and a second set of leads 660*e*, 660*f* and 660*g* disposed on a second side of the lead frame 660. The lead 660*a* serves as a terminal lead and has an inner contact section 661*a* disposed on a plane A-A of the bottom lead frame 660. A side view of the power inductor 600 is shown in FIG. 6C and illustrates the referenced planes. Bottom leads 660*b* and 660*c* include inner contact sections 661*b* and 661*c* respectively disposed on the plane A-A. Bottom leads 660*b* and 660*c* further include outer contact sections 663*b* and 663*c* respectively disposed on the plane B-B that is parallel, and above, the plane A-A.

Lead 660*e* of the bottom lead frame 660 serves as a terminal lead and has an outer contact section 663*e* disposed on the plane B-B. Bottom leads 660*f* and 660*g* include inner contact sections 661*f* and 661*g* respectively disposed on the plane A-A. Bottom leads 660*f* and 660*g* further include outer contact sections 663*f* and 663*g* respectively disposed on the plane B-B.

A coil is formed about the magnetic core 610 as shown in FIG. 6A. The inner contact section 661*a* of the lead 660*a* is coupled to the inner contact section 321*a* of the lead 320*a* by means of via 610*a*. The outer contact section 323*a* of the lead 320*a* is coupled to the outer contact section 663*b* of the adjacent lead 660*b*. The inner contact section 661*b* of the lead 660*b* is coupled to the inner contact section 321*b* of the lead 320*b* by means of via 610*b*. The outer contact section 323*b* of the lead 320*b* is coupled to the outer contact section 663*c* of the adjacent lead 660*c*. The inner contact section 661*c* of the lead 660*c* is coupled to the inner contact section 321*c* of the lead 320*c* by means of via 610*c*. The outer contact section 323*c* of the lead 320*c* is coupled to the outer contact section 663*d* of the adjacent lead 660*d*. The lead 660*d* comprises a routing section 665*d* (FIG. 6D) that routes the coil circuit to connect the inner contact section 661*d* of the lead 660*d* to the inner contact section 321*f* of the lead 320*f* by means of via 610*f*. The outer contact section 323*f* of the lead 320*f* is coupled to the outer contact section 663*g* of the adjacent lead 660*g*. The inner contact section 661*g* of the lead 660*g* is coupled to the inner contact section 321*e* of the lead 320*e* by means of via 610*e*. The outer contact section 323*e* of the lead 320*e* is coupled to the outer contact section 663*f* of the adjacent lead 660*f*. The inner contact section 661*f* of the lead 660*f* is coupled to the inner contact section 321*d* of the lead 320*d* by means of via 610*d*. The outer contact section 323*d* of the lead 320*d* is coupled to the outer contact section 663*e* of the lead 660*e*.

The discrete power inductor 600 may include terminals 660*a* and 660*e*, the interconnection between the leads of the top and bottom lead frames 320 and 660 forming the coil through the magnetic core 610.

The discrete power inductor 600 may be encapsulated with an encapsulant to form a package (not shown). The encapsulant may include conventional encapsulating materials. Alternatively, the encapsulant may include materials incorporating magnetic powders such as ferrite particles to provide shielding and improved magnetic performance.

Figure 7A:
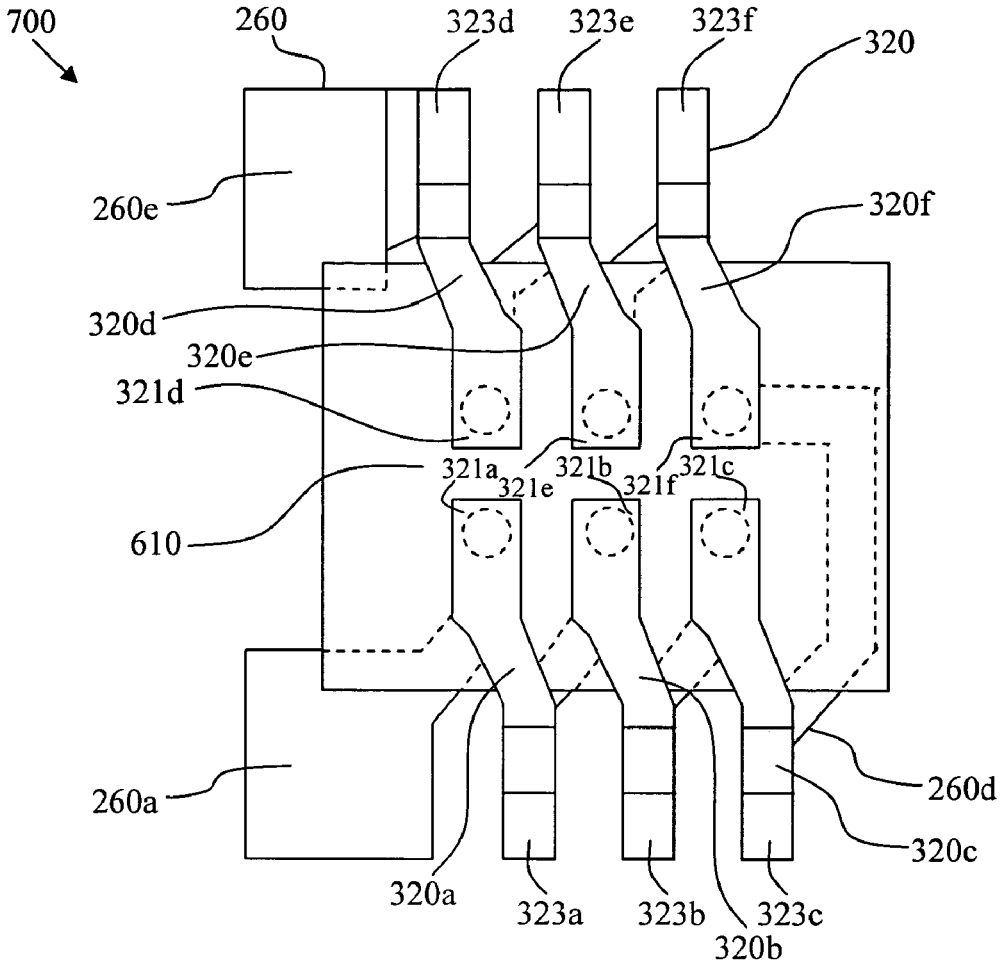
FIG. 7A is a top plan view of a seventh embodiment of the lead frame-based discrete power inductor in accordance with the invention.
Figure 7B:
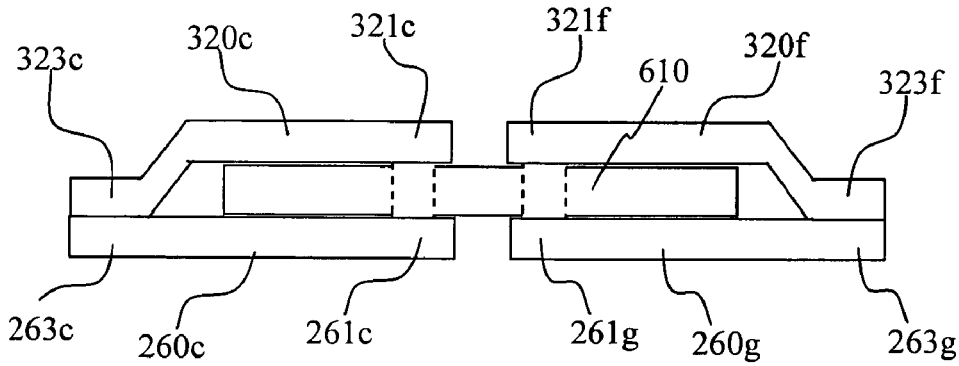
FIG. 7B is a side elevation view of the lead frame-based discrete power inductor of FIG. 7A.

A seventh embodiment of a lead frame-based discrete power inductor generally designated 700 is shown in FIGS. 7A and 7B wherein portions of the leads of the bottom lead frame 260 are shown in phantom lines. The power inductor 700 comprises the magnetic core 610, the top lead frame 320 and the bottom lead frame 260. The magnetic core 610 includes six conductive through vias 610*a*, 610*b*, 610*c*, 610*d*, 610*e* and 610*f* spaced and configured to provide interconnection between the inner contact sections of the leads of the top lead frame 320 and the bottom lead frame 260.

A coil is formed through the magnetic core 610 as shown in FIG. 7A. The inner contact section 261*a* of the lead 260*a* is coupled to the inner contact section 321*a* of the lead 320*a* by means of via 610*a*. The outer contact section 323*a* of the lead 320*a* is coupled to the outer contact section 263*b* of the adjacent lead 260*b*. The inner contact section 261*b* of the lead 260*b* is coupled to the inner contact section 321*b* of the lead 320*b* by means of via 610*b*. The outer contact section 323*b* of the lead 320*b* is coupled to the outer contact section 263*c* of the adjacent lead 260*c*. The inner contact section 261*c* of the lead 260*c* is coupled to the inner contact section 321*c* of the lead 320*c* by means of via 610*c*. The outer contact section 323*c* of the lead 320*c* is coupled to the outer contact section 263*d* of the adjacent lead 260*d*. The lead 260*d* comprises a routing section 265*d* (FIG. 2C) that routes the coil circuit to connect the inner contact section 261*d* of the lead 260*d* to the inner contact section 321*f* of the lead 320*f* by means of via 610*f*. The outer contact section 323*f* of the lead 320*f* is coupled to the outer contact section 263*g* of the adjacent lead 260*g*. The inner contact section 261*g* of the lead 260*g* is coupled to the inner contact section 321*e* of the lead 320*e* by means of via 610*e*. The outer contact section 323*e* of the lead 320*e* is coupled to the outer contact section 263*f* of the adjacent lead 260*f*. The inner contact section 261*f* of the lead 260*f* is coupled to the inner contact section 321*d* of the lead 320*d* by means of via 610*d*. The outer contact section 323*d* of the lead 320*d* is coupled to the outer contact section 263*e* of the lead 260*e*.

The discrete power inductor 700 may include terminals 260*a* and 260*e*, the interconnection between the leads of the top and bottom lead frames 320 and 260 forming the coil through the magnetic core 610.

The discrete power inductor 700 may be encapsulated with an encapsulant to form a package (not shown). The encapsulant may include conventional encapsulating materials. Alternatively, the encapsulant may include materials incorporating magnetic powders such as ferrite particles to provide shielding and improved magnetic performance.

Figure 8A:
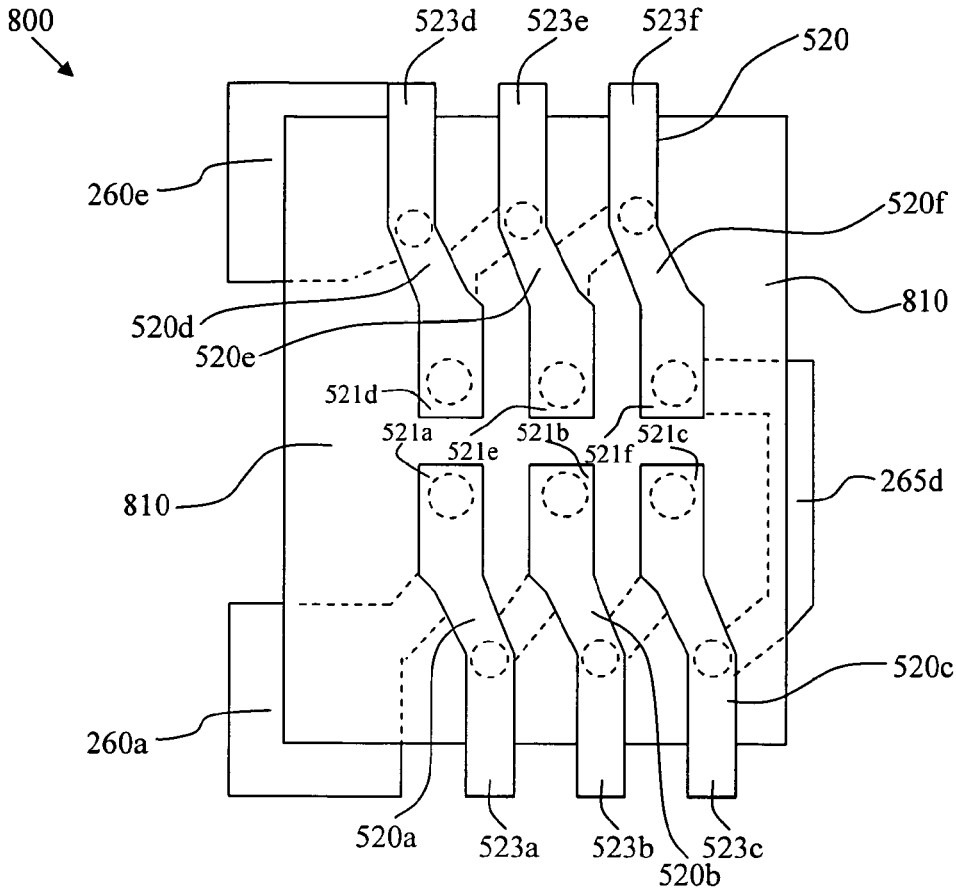
FIG. 8A is a top plan view of an eighth embodiment of the lead frame-based discrete power inductor in accordance with the invention.
Figure 8B:
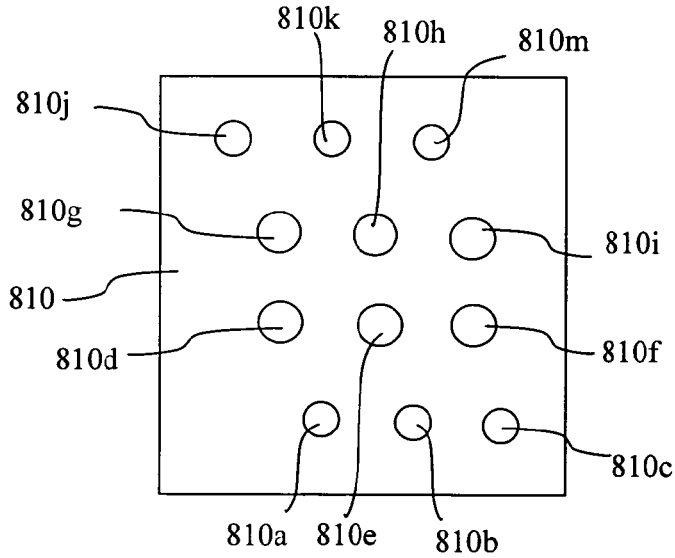
FIG. 8B is a top plan view of a magnetic core in accordance with the invention.
Figure 8C:
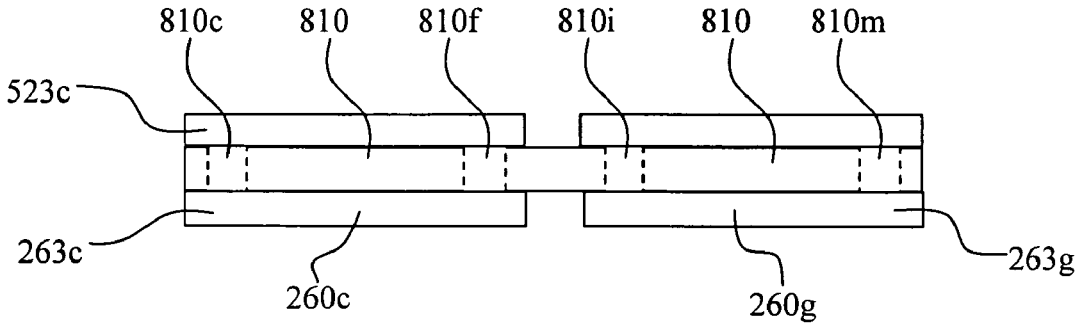
FIG. 8C is a side elevation view of the lead frame-based discrete power inductor of FIG. 8A.

An eighth embodiment of a lead frame-based discrete power inductor generally designated 800 is shown in FIGS. 8A and 8C wherein portions of the leads of the bottom lead frame 260 are shown in phantom lines. The power inductor 800 comprises a magnetic core 810, the top lead frame 520 and the bottom lead frame 260. The magnetic core 810 includes twelve conductive through vias 810*a*, 810*b*, 810*c*, 810*d*, 810*e*, 810*f*, 810*g*, 810*h*, 810*i*, 810*j*, 810*k* and 810*m* (shown in phantom lines in FIG. 8A) spaced and configured to provide interconnection between the inner and outer contact sections of the leads of the top lead frame 520 and the bottom lead frame 260.

A coil is formed through the magnetic core 810 as shown in FIG. 8A. The inner contact section 261*a* of the lead 260*a* is coupled to the inner contact section 521*a* of the lead 520*a* by means of via 810*d*. The outer contact section 523*a* of the lead 520*a* is coupled to the outer contact section 263*b* of the adjacent lead 260*b* by means of via 810*a*. The inner contact section 261*b* of the lead 260*b* is coupled to the inner contact section 521*b* of the lead 520*b* by means of via 810*e*. The outer contact section 523*b* of the lead 520*b* is coupled to the outer contact section 263*c* of the adjacent lead 260*c* by means of via 810*b*. The inner contact section 261*c* of the lead 260*c* is coupled to the inner contact section 521*c* of the lead 520*c* by means of via 810*f*. The outer contact section 523*c* of the lead 520*c* is coupled to the outer contact section 263*d* of the adjacent lead 260*d* by means of via 810*c*. The lead 260*d* comprises a routing section 265*d* (FIG. 2C) that routes the coil circuit to connect the inner contact section 261*d* of the lead 260*d* to the inner contact section 521*f* of the lead 520*f* by means of via 810*i*. The outer contact section 263*g* of the lead 260*g* is coupled to the outer contact section 523*f* of the adjacent lead 520*f* by means of via 810*m*. The inner contact section 521*e* of the lead 520*e* is coupled to the inner contact section 261*g* of the lead 260*g* by means of via 810*h*. The outer contact section 263*f* of the lead 260*f* is coupled to the outer contact section 523*e* of the lead 520*e* by means of via 810*k*. The inner contact section 521*d* of the lead 520*d* is coupled to the inner contact section 2661*f* of the lead 260*f* by means of via 810*g*. The outer contact section 523*d* of the lead 520*d* is coupled to the outer contact section 262*e* of the lead 260*e* by means of via 810*j*.

The discrete power inductor 800 may include terminals 260*a* and 260*e*, the interconnection between the leads of the top and bottom lead frames 520 and 260 forming the coil through the magnetic core 810.

The discrete power inductor 800 may be encapsulated with an encapsulant to form a package (not shown). The encapsulant may include conventional encapsulating materials. Alternatively, the encapsulant may include materials incorporating magnetic powders such as ferrite particles to provide shielding and improved magnetic performance.

Figure 9A:
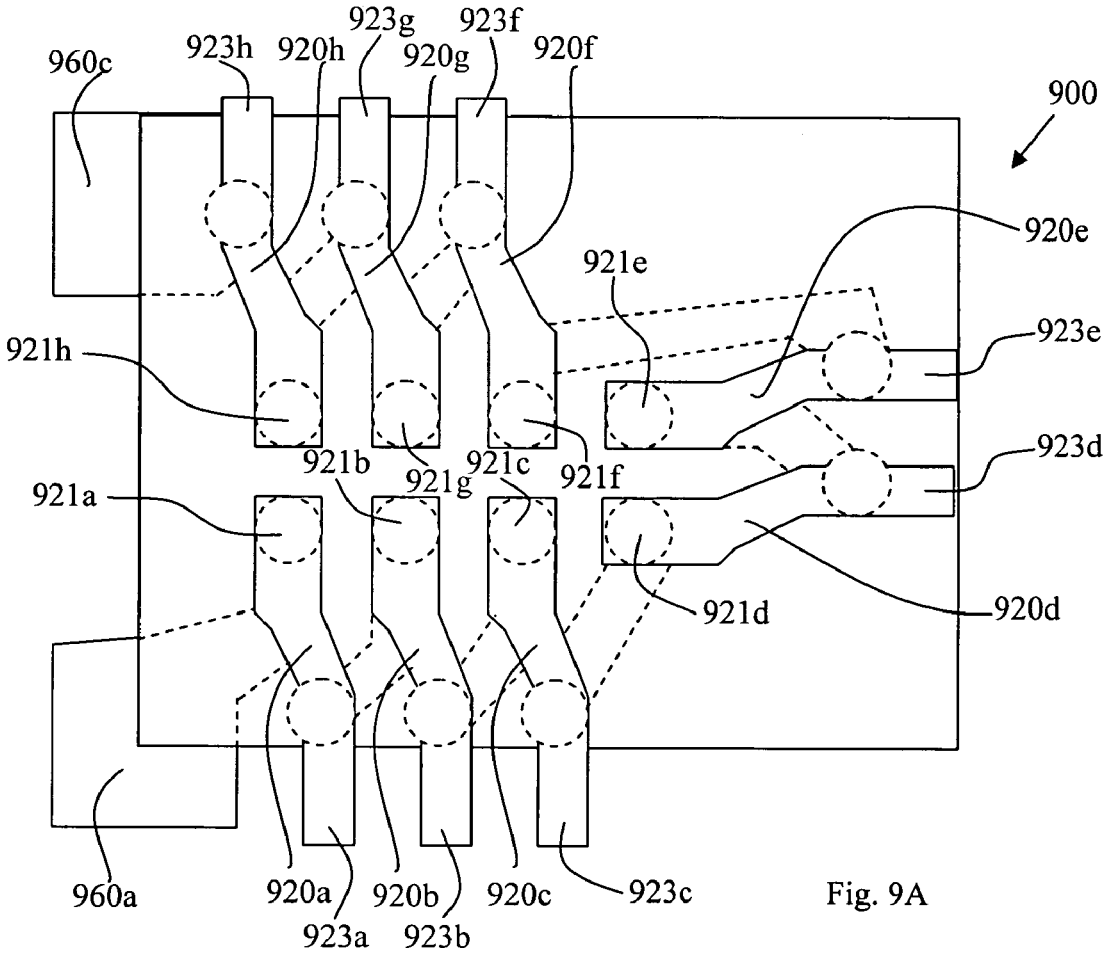
FIG. 9A is a top plan view of a ninth embodiment of the lead frame-based discrete power inductor in accordance with the invention.
Figure 9B:
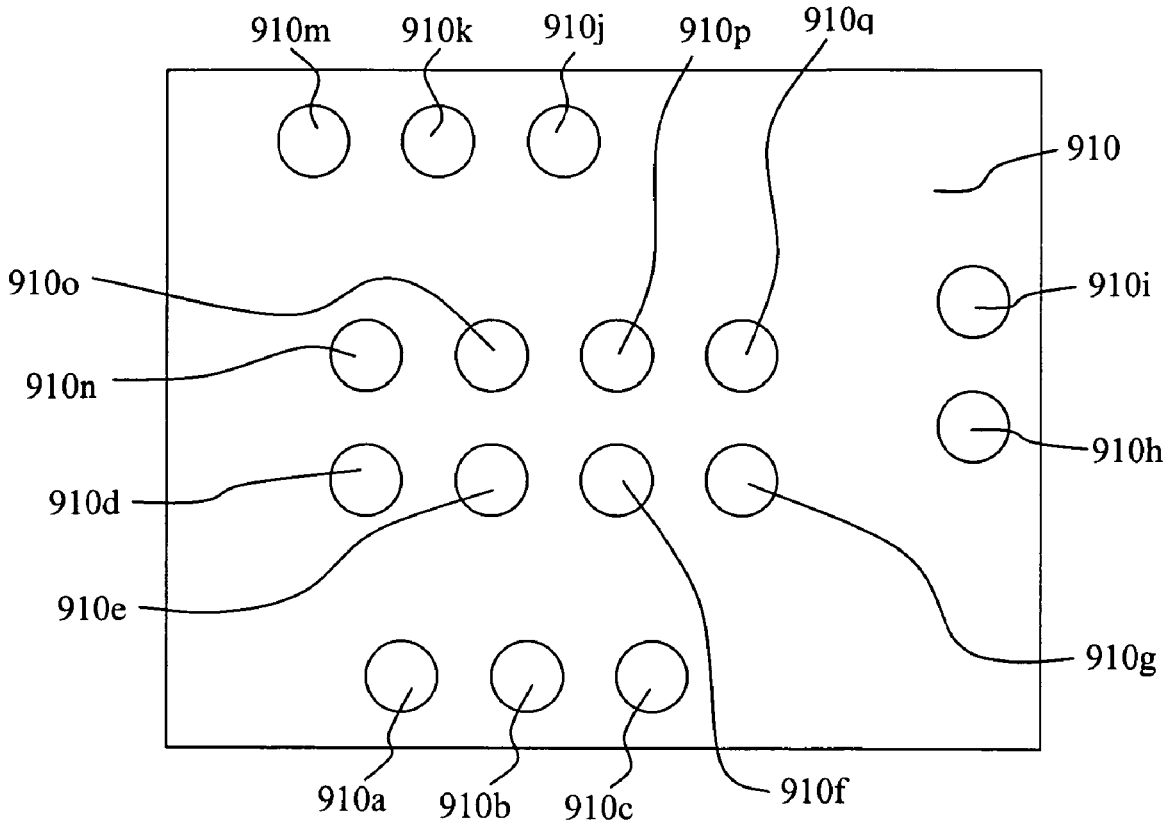
FIG. 9B is a top plan view of a magnetic core in accordance with the invention.
Figure 9C:
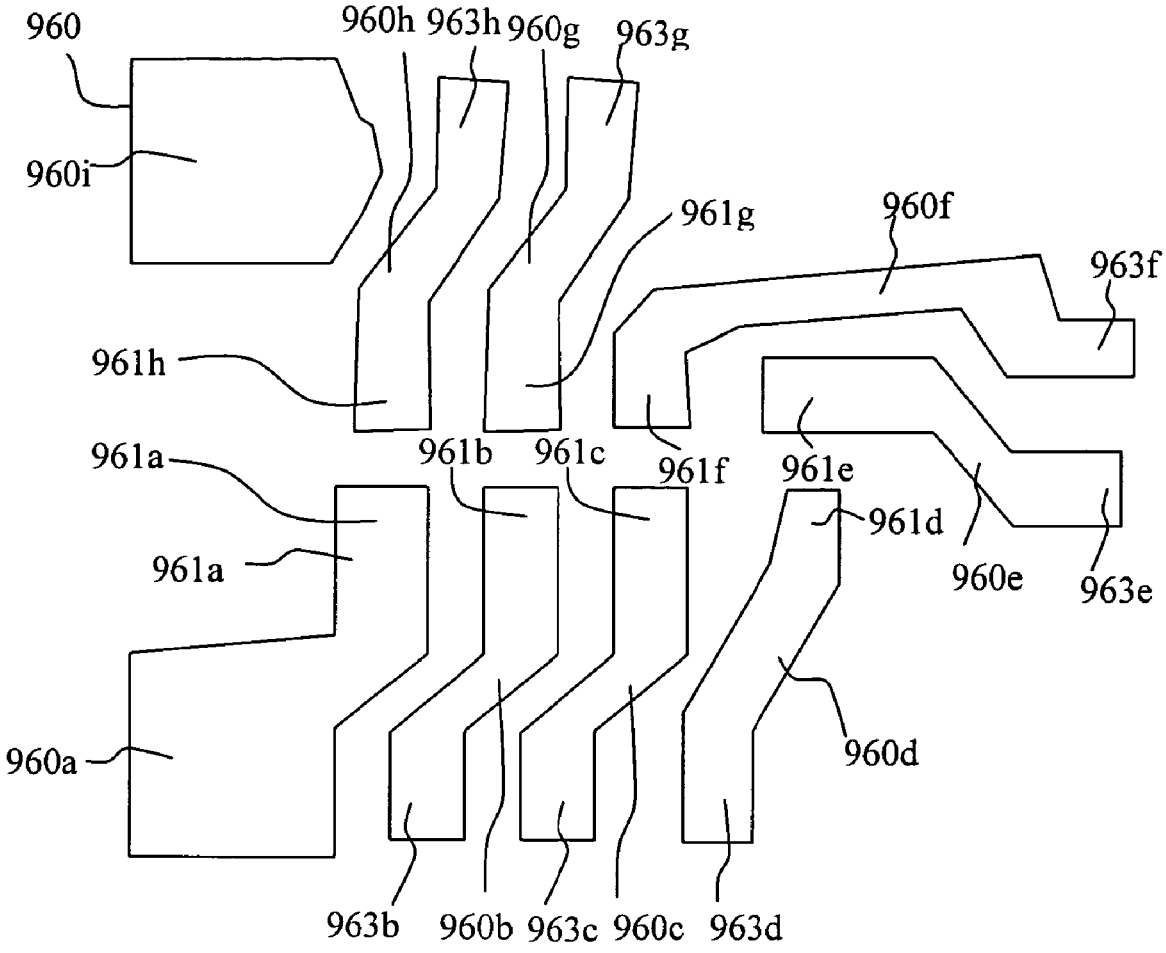
FIG. 9C is a top plan view of a bottom lead frame in accordance with the invention.
Figure 9D:
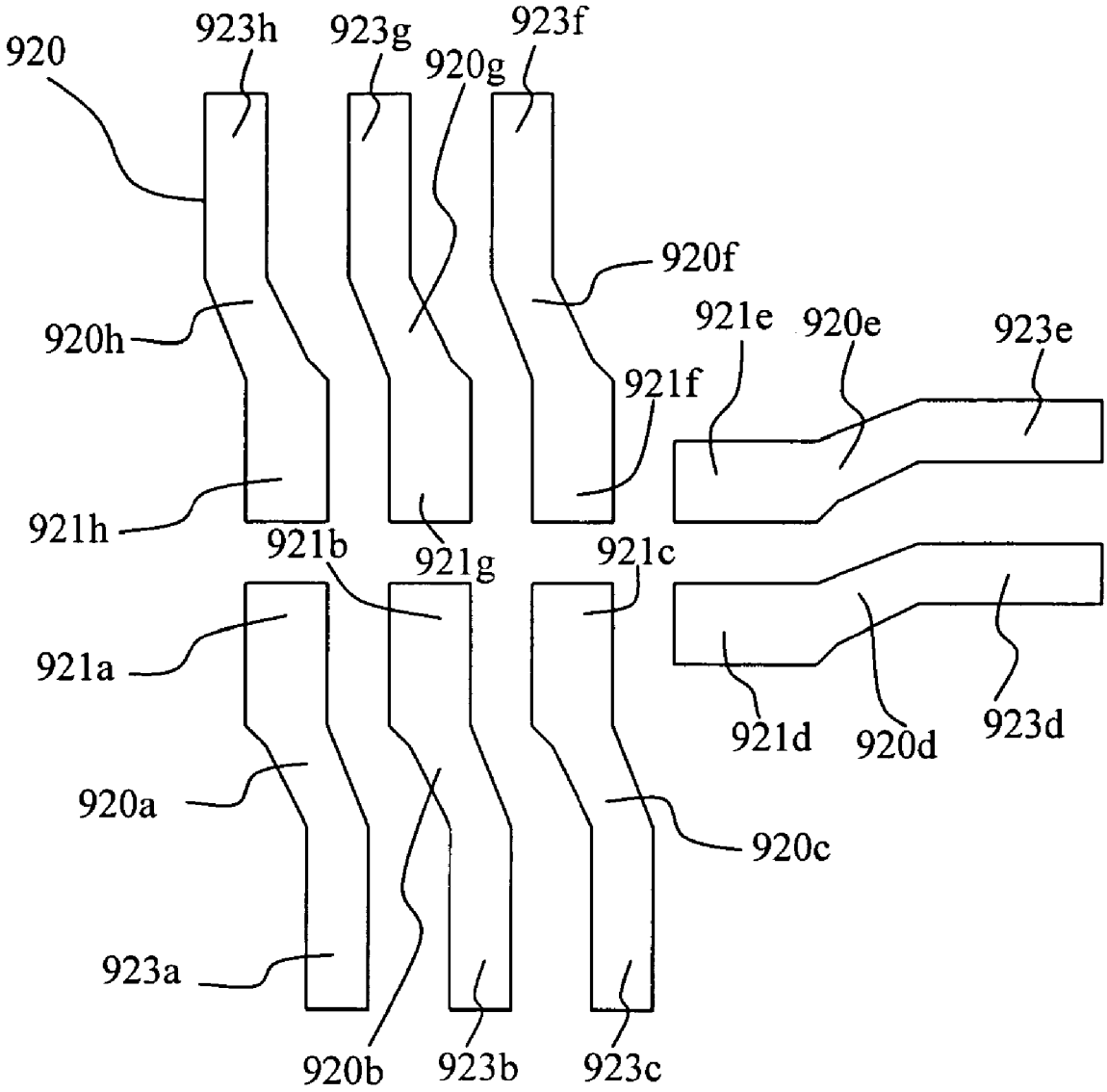
FIG. 9D is a top plan view of a top lead frame in accordance with the invention.

A ninth embodiment of a lead frame-based discrete power inductor generally designated 900 is shown in FIG. 9A wherein portions of the leads of a bottom lead frame 960 are shown in phantom lines. The power inductor 900 comprises a magnetic core 910 (FIG. 9B), a top lead frame 920 (FIG. 9D) and the bottom lead frame 960 (FIG. 9C). The top and bottom lead frames 920 and 960 provide additional leads (compared to those of the previously described embodiments) to thereby provide additional turns of the coil to the power inductor 900. The additional turns are shown disposed on a third side of the top and bottom lead frames 920 and 960.

The magnetic core 910 includes conductive through vias spaced and configured to provide interconnection between inner and outer contact sections of the leads of the top lead frame 920 and the bottom lead frame 960.

Top lead frame 920 includes leads 920*a*, 920*b*, 920*c*, 920*d*, 920*e*, 920*f*, 920*g* and 920*h*. Leads 920*a*, 920*b*, 920*c*, 920*d*, 920*e*, 920*f*, 920*g* and 920*h* each comprise planar inner contact sections 921*a*, 921*b*, 921*c*, 921*d*, 921*e*, 921*f*, 921*g* and 921*h* respectively. Leads 920*a*, 920*b*, 920*c*, 920*d*, 920*e*, 920*f*, 920*g* and 920*h* each further comprise planar outer contact sections 923*a*, 923*b*, 923*c*, 923*d*, 923*e*, 923*f*, 923*g* and 923*h* respectively.

Bottom lead frame 960 includes leads 960*a*, 960*b*, 960*c*, 960*d*, 960*e*, 960*f*, 960*g*, 960*h* and 960*i*. Bottom leads 960*b*, 960*c*, 960*d*, 960*e*, 960*f*, 960*g* and 960*h* each comprise planar inner contact sections 961*b*, 961*c*, 961*d*, 961*e*, 961*f*, 961*g* and 961*h* respectively. Bottom leads 960*b*, 960*c*, 960*d*, 960*e*, 960*f*, 960*g*, and 960*h* each further comprise planar outer contact sections 963*b*, 963*c*, 963*d*, 963*e*, 963*f*, 963*g* and 963*h* respectively. Terminal lead 960*a* includes a planar inner section 961*a*. Terminal lead 960*i* includes a planar outer contact section 963*i*.

The magnetic core 910 comprises a plurality of connective through vias 910*a*, 910*b*, 910*c*, 910*d*, 910*e*, 910*f*, 910*g*, 910*h*, 910*i*, 910*j*, 910*k*, 910*m*, 910*n*, 910*o*, 910*p* and 910*q*. Vias 910*a*, 910*b*, 910*c*, 910*d*, 910*e*, 910*f*, 910*g*, 910*h*, 910*i*, 910*j*, 910*k*, 910*m*, 910*n*, 910*o*, 910*p* and 910*q* are spaced and configured to provide interconnection between inner and outer contact sections of the leads of the top lead frame 920 and the bottom lead frame 960.

A coil is formed through the magnetic core 910 as shown in FIG. 9A. The inner section 961*a* of the lead 960*a* is coupled to the inner section 921*a* of the lead 920*a* by means of via 910*d*. The outer section 923*a* of the lead 920*a* is coupled to the outer section 963*b* of the lead 960*b* by means of via 910*a*. The inner section 961*b* of the lead 960*b* is coupled to the inner section 921*b* of the lead 920*b* by means of via 910*e*. The outer section 923*b* of the lead 920*b* is coupled to the outer section 963*c* of the lead 960*c* by means of via 910*b*. The inner section 961*c* of the lead 960*c* is coupled to the inner section 921*c* of the lead 920*c* by means of via 910*f*. The outer section 923*c* of the lead 920*c* is coupled to the outer section 963*d* of the lead 960*d* by means of via 910*c*. The inner section 961*d* of lead 960*d* is coupled to the inner section 921*d* of the lead 920*d* by means of via 910*g*. The outer section 923*d* of the lead 920*d* is coupled to the outer section 963*e* of the lead 960*e* by means of via 910*h*. The inner section 961*e* of the lead 960*e* is coupled to the inner section 921*e* of the lead 920*e* by means of via 910*q*. The outer section 923*e* of the lead 920*e* is coupled to the outer section 963*f* of the lead 960*f* by means of via 910*i*. The inner section 961*f* of the lead 960*f* is coupled to the inner section 921*f* of the lead 920*f* by means of via 910*p*. The outer section 923*f* of the lead 920*f* is coupled to the outer section 963*g* of the lead 960*g* by means of via 910*j*. The inner section 961*g* of the lead 960*g* is coupled to the inner section 921*b* of the lead 920*b* by means of via 910*o*. The outer section 923*g* of the lead 920*g* is coupled to the outer section 963*h* of the lead 960*h* by means of via 910*k*. The inner section 961*h* of the lead 960*h* is coupled to the inner section 921*h* of the lead 920*h* by means of via 910*n*. The outer section 923*h* of the lead 920*h* is coupled to the lead 960*i* by means of via 910*m*.

The discrete power inductor 900 may include terminals 960*a* and 960*i*, the interconnection between the leads of the top and bottom lead frames 920 and 960 forming the coil through the magnetic core 910.

The lead frame-based discrete power inductor of the invention provides a compact power inductor that maximizes inductance per unit area. Effective magnetic coupling is achieved using an efficient closed magnetic loop with a single magnetic core structure. The power inductor of the invention further provides a power inductor that combines a small physical size with a minimum number of turns to provide a small footprint and thin profile. Further, the power inductor of the invention is easily manufacturable in high volume using existing semiconductor packaging techniques at a low cost.

It is apparent that the above embodiments may be altered in many ways without departing from the scope of the invention. Further, various aspects of a particular embodiment may contain patentably subject matter without regard to other aspects of the same embodiment. Still further, various aspects of different embodiments can be combined together. Accordingly, the scope of the invention should be determined by the following claims and their legal equivalents.

What is claimed is:

1. A lead frame-based discrete power inductor comprising:

a top lead frame including a first side and a second side, the first side being disposed opposite the second side, the first side having a first set of leads and the second side having a second set of leads, each of the leads of the first set of leads and of the second set of leads having an inner contact section and an outer contact section;

a bottom lead frame including a first side and a second side, the first side being disposed opposite the second side, the first side having a first set of leads and the second side having a second set of leads, the first set of leads having a first terminal lead having an inner contact section and a terminal section, each of the remaining leads of the first set of leads having an inner contact section and an outer contact section, the second set of leads having a second terminal lead having an outer contact section and a terminal section, each of the remaining leads of the second set of leads having an inner contact section and an outer contact section;

a routing lead having an outer contact section disposed on the first side of the top lead frame and an inner contact section disposed on the second side of the top lead frame;

a magnetic core having a plurality of connective vias formed therethrough, the magnetic core being disposed between the top lead frame and the bottom lead frame such that the first side of the top lead frame is aligned with the first side of the bottom lead frame, the connective vias being spaced and arranged to provide interconnection between the inner contact section of first terminal lead and the inner contact sections of the remaining leads of the bottom lead frame first set of leads and respective inner contact sections of the top lead frame first set of leads and to the inner contact section of the routing lead and the inner contact sections of the remaining leads of the bottom lead frame second set of leads are coupled to respective inner contact sections of the top lead frame second set of leads, the outer contact sections of the top lead frame first set of leads being coupled to respective outer contact sections of the remaining leads of the bottom lead frame first set of leads and to the outer contact section of the routing lead, and the outer contact sections of the top lead frame second set of leads being coupled to respective outer contact sections of the remaining leads of the bottom lead frame second set of leads and to the outer contact section of the second terminal lead to provide a coil about the magnetic core.

2. The lead frame-based discrete inductor of claim 1, wherein the outer contact sections of the leads of the top lead frame first and second set of leads are disposed in a plane parallel to, and below, a plane of the inner contact sections, the outer contact sections of the remaining leads of the bottom lead frame first and second set of leads are disposed in a plane parallel to, and above, a plane of the inner contact sections, and the outer contact section of the routing lead is disposed in the plane parallel to, and above, the plane of the inner contact sections of the leads of the bottom lead frame.

3. The lead frame-based discrete inductor of claim 1, wherein the leads of the top lead frame first and second set of leads are bent about a portion of the magnetic core, the inner and outer contact sections thereof being disposed in a plane parallel to, and below a plane of the top lead frame, and the leads of the bottom lead frame first and second set of leads are planar.

4. The lead frame-based discrete power inductor of claim 1, wherein the magnetic core further comprises outer connective vias formed therethrough, the outer connective vias being spaced and arranged to provide interconnection between the outer contact sections of the top lead frame first set of leads and respective outer contact sections of the remaining leads of the bottom lead frame first set of leads and to the outer contact section of the routing lead, and to the outer contact sections of the top lead frame second set of leads and outer contact sections of the remaining leads of the bottom lead frame second set of leads and to the outer contact section of the second terminal lead to provide a closed magnetic circuit about the magnetic core.

5. The lead frame-based discrete power inductor of claim 4, wherein the leads of the top lead frame first and second set of leads are planar, and the leads of the bottom lead frame first and second set of leads are planar.

* * * * *